US009726354B1

(12) United States Patent
Delano et al.

(10) Patent No.: US 9,726,354 B1
(45) Date of Patent: Aug. 8, 2017

(54) LIGHT FIXTURE WITH MOVABLE ENCLOSURE

(71) Applicants: Howard D. Delano, Kingston, NY (US); Frank Cogliano, Pomona, NY (US)

(72) Inventors: Howard D. Delano, Kingston, NY (US); Frank Cogliano, Pomona, NY (US)

(73) Assignee: USAI, LLC, New Windsor, NY (US)

( * ) Notice: Subject to any disclaimer, the term of this patent is extended or adjusted under 35 U.S.C. 154(b) by 0 days.

(21) Appl. No.: 15/295,606

(22) Filed: Oct. 17, 2016

Related U.S. Application Data

(63) Continuation of application No. 15/268,251, filed on Sep. 16, 2016, now abandoned.

(51) Int. Cl.

| | |
|---|---|
| ***F21V 21/14*** | (2006.01) |
| ***F21V 29/74*** | (2015.01) |
| ***F21V 17/02*** | (2006.01) |
| ***F21V 23/06*** | (2006.01) |
| ***F21V 23/00*** | (2015.01) |
| ***F21V 25/02*** | (2006.01) |
| ***F21S 8/02*** | (2006.01) |
| *F21Y 115/10* | (2016.01) |

(52) U.S. Cl.
CPC ..... *F21V 21/14* (2013.01); *F21S 8/026* (2013.01); *F21V 17/02* (2013.01); *F21V 23/003* (2013.01); *F21V 23/06* (2013.01); *F21V 25/02* (2013.01); *F21V 29/74* (2015.01); *F21Y 2115/10* (2016.08)

(58) Field of Classification Search
CPC ..... F21S 8/026; F21S 8/02; F21S 8/04; F21V 17/02; F21V 21/14; F21V 23/003; F21V 23/06; F21V 25/02; F21V 29/74
USPC ..... 362/368; 220/3.7, 3.92, 3.94; 312/223.5
See application file for complete search history.

(56) References Cited

U.S. PATENT DOCUMENTS

| | | | | |
|---|---|---|---|---|
| 7,478,931 | B2 * | 1/2009 | Miletich | F21S 8/02 362/147 |
| 8,684,570 | B1 * | 4/2014 | Fuchs | F21S 8/026 362/418 |
| 2008/0304269 | A1 * | 12/2008 | Pickard | F21V 21/048 362/365 |

(Continued)

*Primary Examiner* — Laura Tso
*Assistant Examiner* — Naomi M Wolford
(74) *Attorney, Agent, or Firm* — St. Onge Steward Johnston & Reens LLC

(57) ABSTRACT

A light fixture has a frame with an aperture and an enclosure having a driver compartment and a junction compartment. The enclosure is movable relative to the frame. In an operation position, the driver and junction compartments are laterally displaced from the aperture and a lighting module is mountable in the aperture from a room-facing side of the light fixture. In a service position, an opening of the driver compartment is laterally aligned with the aperture such that the lighting driver is removably mountable in the driver compartment through the aperture and the opening of the driver compartment, from the room-facing side of the light fixture. In an inspection position, an opening of the junction compartment is laterally aligned with the aperture, and an interior of the junction compartment is visible through the aperture and the opening of the junction compartment, from a room-facing side of the light fixture.

13 Claims, 24 Drawing Sheets

(56) References Cited

U.S. PATENT DOCUMENTS

2011/0103062 A1* 5/2011 Park ..... F21S 8/02
362/282

* cited by examiner

LIGHT FIXTURE WITH MOVABLE ENCLOSURE

FIELD OF THE INVENTION

The present invention is directed to the field of light fixtures, and in particular to recessed light fixtures.

BACKGROUND OF THE INVENTION

Recessed lighting is very popular in residential and commercial buildings given its unobtrusive and aesthetically pleasing appearance. Recessed lighting removes from view all electric hardware and wiring, placing everything behind a wall or ceiling. However, the electrical components that power the light fixtures must be serviced from time-to-time, particularly the lighting driver that controls and powers the light source. Servicing these components can be problematic when the components are all disposed out of sight and reach.

Accordingly, there is a need in the art for a recessed light fixture that permits the user access to the electrical components, including the lighting driver, without removing the entire light fixture unit from behind the wall or ceiling tile. Since only the light source itself is typically externally accessible, it would be preferable to allow a user access to service the electrical components through the same illumination aperture that permits light to escape from the unit's housing. It is also preferable to provide such access for maintenance using modular, toollessly mountable components.

The present technology seeks to resolve the needs in the art by providing a recessed light fixture that allows access to service electrical components through the illumination aperture without removing the light fixture from its mounts on the building's structure.

SUMMARY OF THE INVENTION

It is therefore an object of the present technology to provide a recessed light fixture that will allow a user to access the electrical components, including the lighting driver, for maintenance through the illumination aperture.

To accomplish its objectives, the present technology provides a light fixture having a frame with an aperture where the frame is adapted to mount to a support structure with a room-facing side of the light fixture facing an interior of a room. A lighting module operable to emit light from the light fixture into the room is removably mountable in the aperture from the room-facing side of the light fixture. An enclosure is connected to the frame and has a driver compartment for housing a lighting driver, where the driver compartment is movable laterally relative to the frame along a movement axis and has bottom with an opening sized and shaped to receive the lighting driver. The enclosure also has a junction compartment for housing an electrical connection between the lighting driver and a power source. The junction compartment has a bottom with an opening, and is disposed laterally from the driver compartment along the movement axis. The junction compartment is movable laterally relative to the frame along the movement axis.

The light fixture has an operation position, a service position and an inspection position. In the operation position, the driver compartment and junction compartment are laterally displaced from the aperture and the lighting module is mountable in the aperture from a room-facing side of the light fixture. In the service position, the opening of the driver compartment is laterally aligned with the aperture such that the lighting driver is removably mountable in the driver compartment through the aperture and the opening of the driver compartment, from the room-facing side of the light fixture. In this position, the junction compartment is laterally displaced from the aperture. In the inspection position, the opening of the junction compartment is laterally aligned with the aperture and an interior of the junction compartment is visible through the aperture and the opening of the junction compartment, from a room-facing side of the light fixture, and the driver compartment is laterally displaced from the aperture.

In an embodiment, in the operation position, the driver compartment and the junction compartment and laterally displaced from the aperture in a first direction. In the service position, the junction compartment is laterally displaced from the aperture in the first direction, and in the inspection position, the driver compartment is laterally displaced from the aperture in a second direction opposite the first direction.

In an embodiment, in the operation position, the driver compartment is laterally displaced from the aperture in a first direction and the junction compartment is laterally displaced from the aperture in a second direction opposite the first direction. In the service position, the junction compartment is laterally displaced from the aperture in the second direction, and in the inspection position, the driver compartment being laterally displaced from the aperture in the first direction.

Those skilled in the art will appreciate the many alterations possible to the presently described technology. The present technology is not limited to the embodiments and arrangements described above. Other objects of the present technology and its particular features and advantages will become more apparent from consideration of the following drawings and detailed description of the technology.

DETAILED DESCRIPTION OF THE INVENTION

The following detailed description illustrates the technology by way of example, not by way of limitation of the principles of the invention. This description will enable one skilled in the art to make and use the technology, and describes several embodiments, adaptations, variations, alternatives, and uses of the invention, including what is presently believed to be the best mode of carrying out the invention. One skilled in the art will recognize alternative variations and arrangements, and the present technology is not limited to those embodiments described hereafter. The light fixture disclosed herein is described as if oriented in a manner to be installed in a horizontal ceiling, using terms such as vertical, horizontal, upper, lower, etc. However, it is to be understood that the light fixture can be placed and used in other orientations, such as vertical walls or other non-horizontal surfaces and that the orientations and relative positions of the various components of the light fixture would likewise change.

Figure 1:
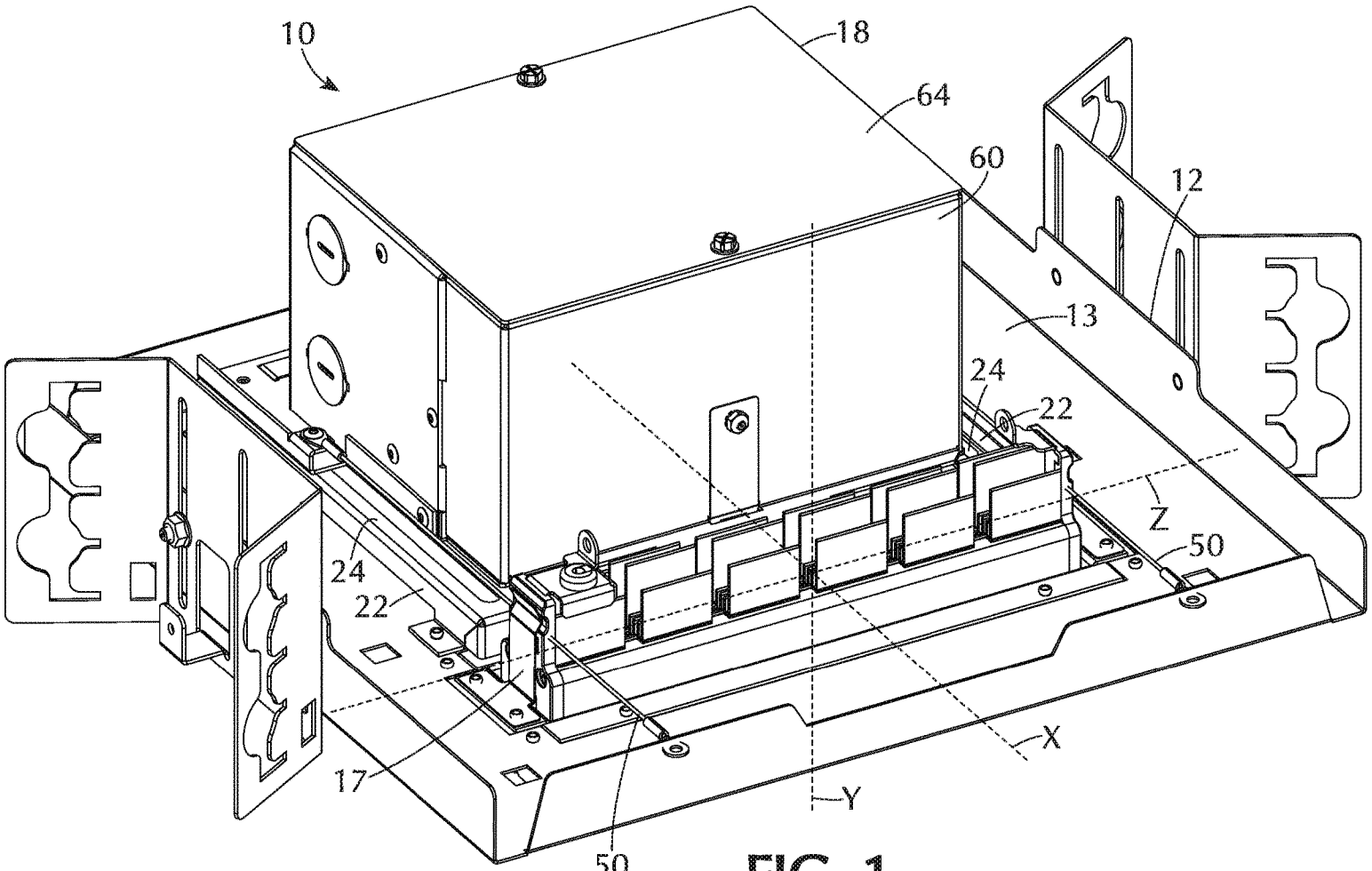
FIG. 1 is a perspective view from the top of a light fixture in accordance with an embodiment of the present invention, showing the enclosure in the operation position and the lighting module installed in the aperture of the frame.
Figure 2:
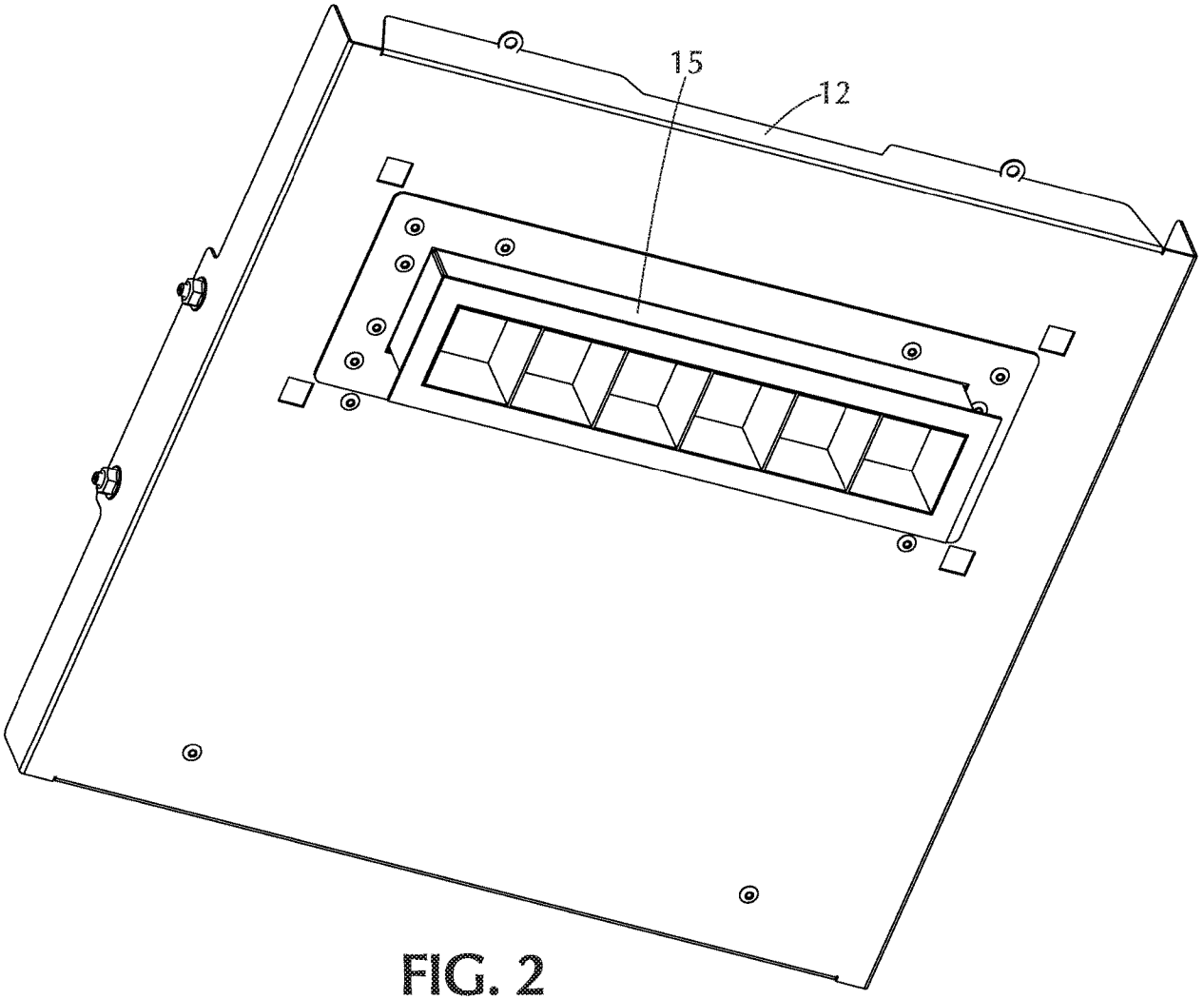
FIG. 2 is a perspective view from the bottom of the light fixture of FIG. 1.
Figure 3:
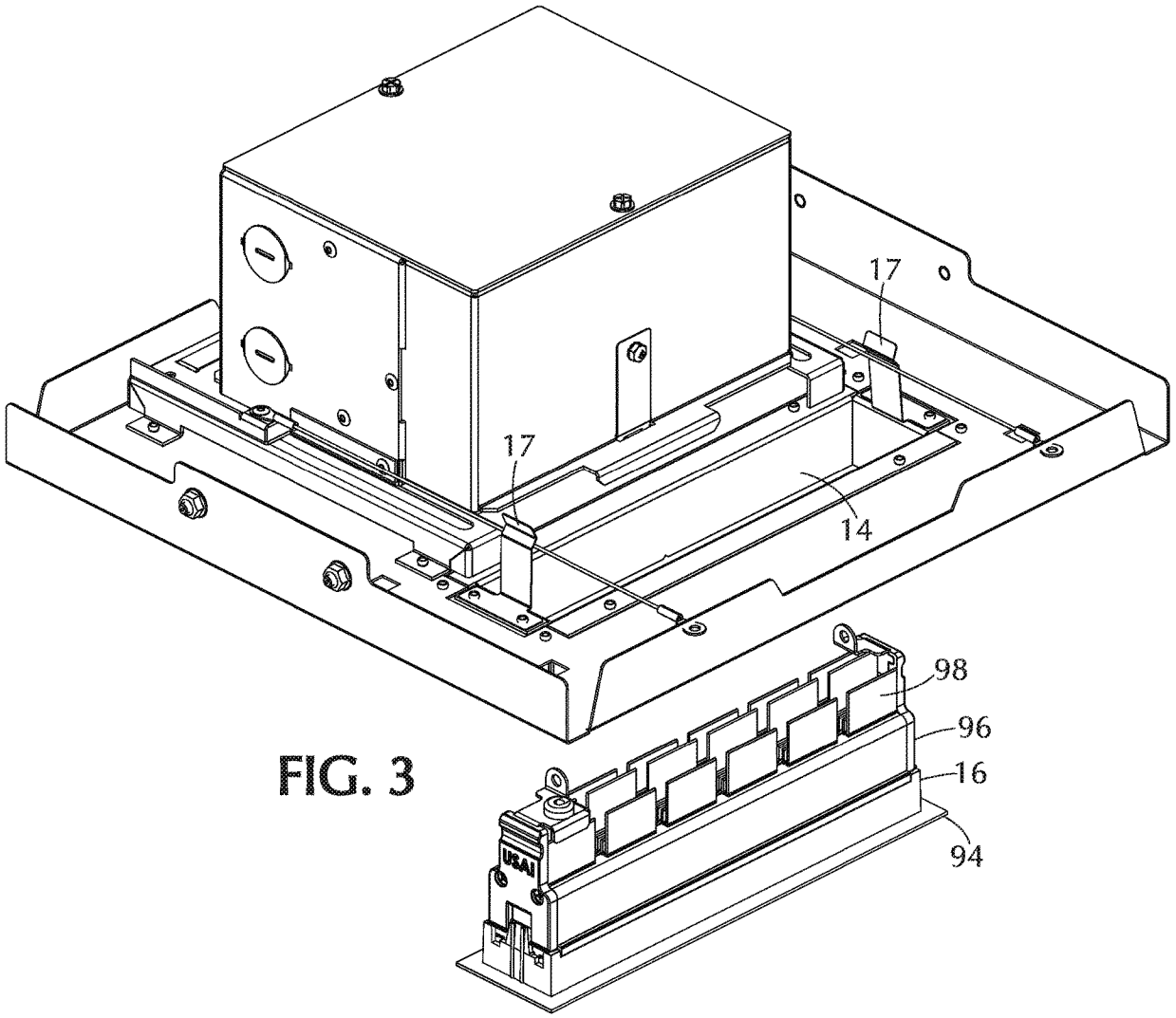
FIG. 3 is a perspective view from the top of the light fixture of FIG. 1, showing the enclosure in the operation position and the lighting module removed.
Figure 4:
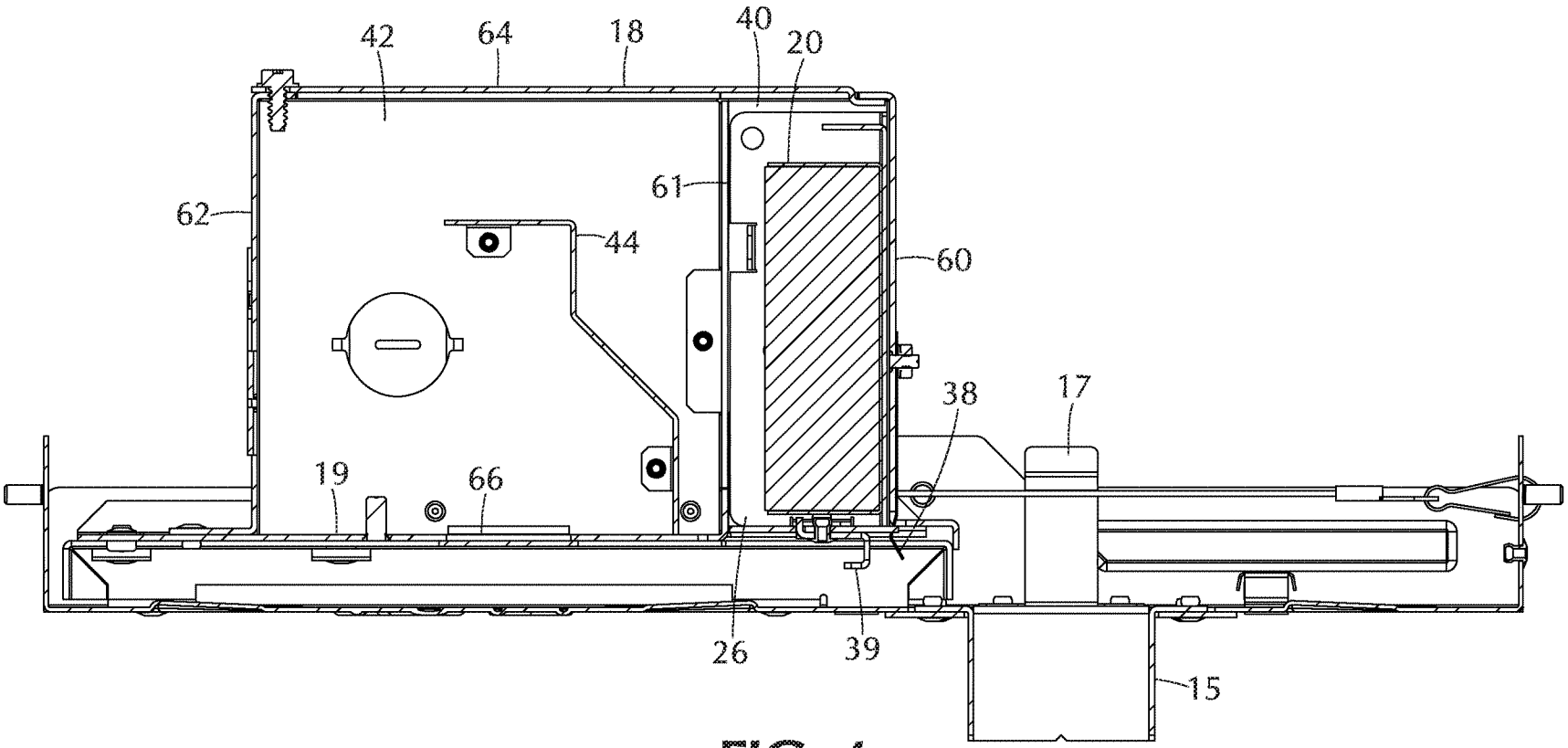
FIG. 4 is a cross-section view of the light fixture of FIG. 1 taken in a vertical plane, showing the driver drawer installed in the enclosure.
Figure 5:
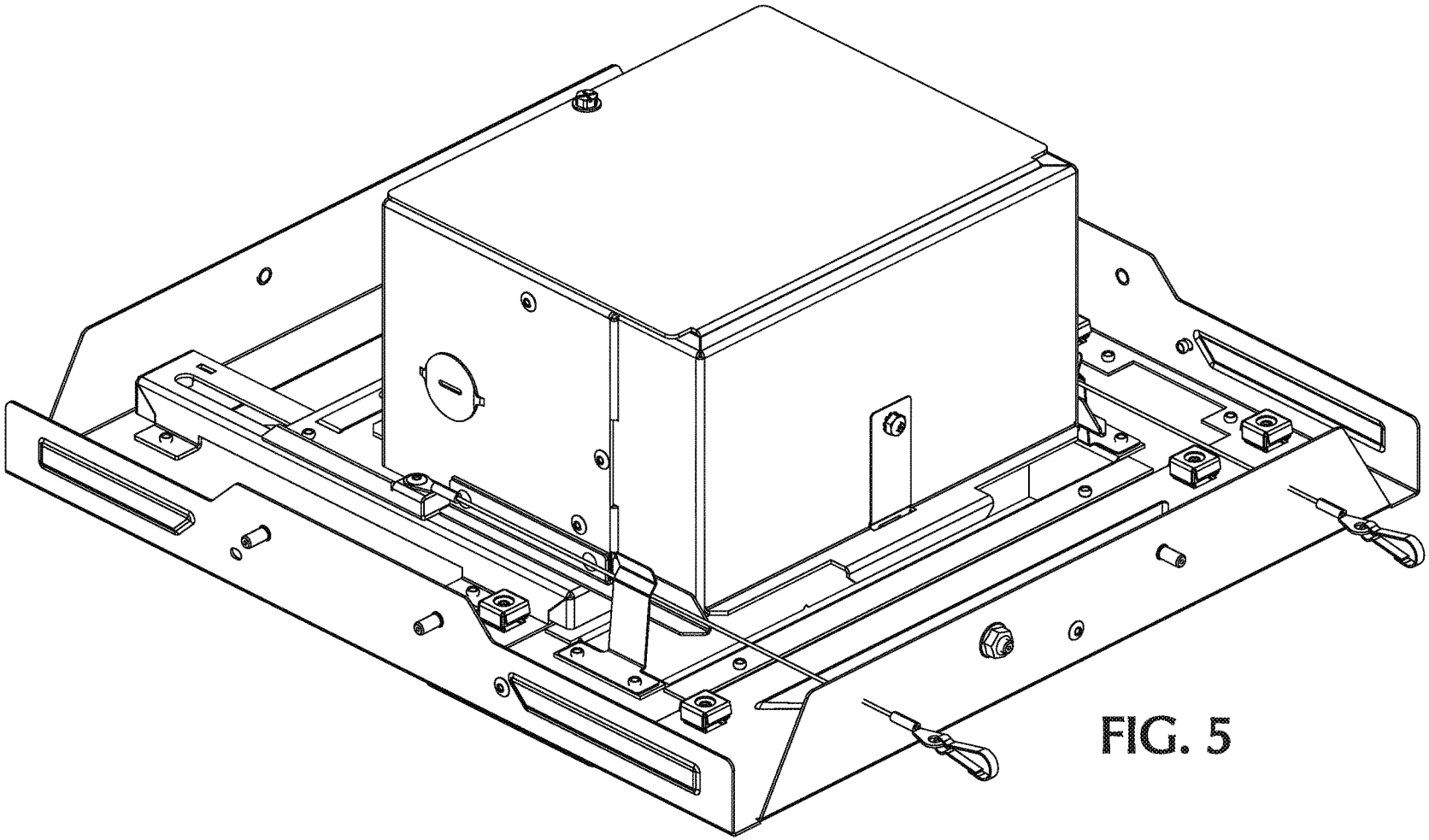
FIG. 5 a perspective view from the top of the light fixture of FIG. 1, showing the enclosure in the service position.
Figure 6:
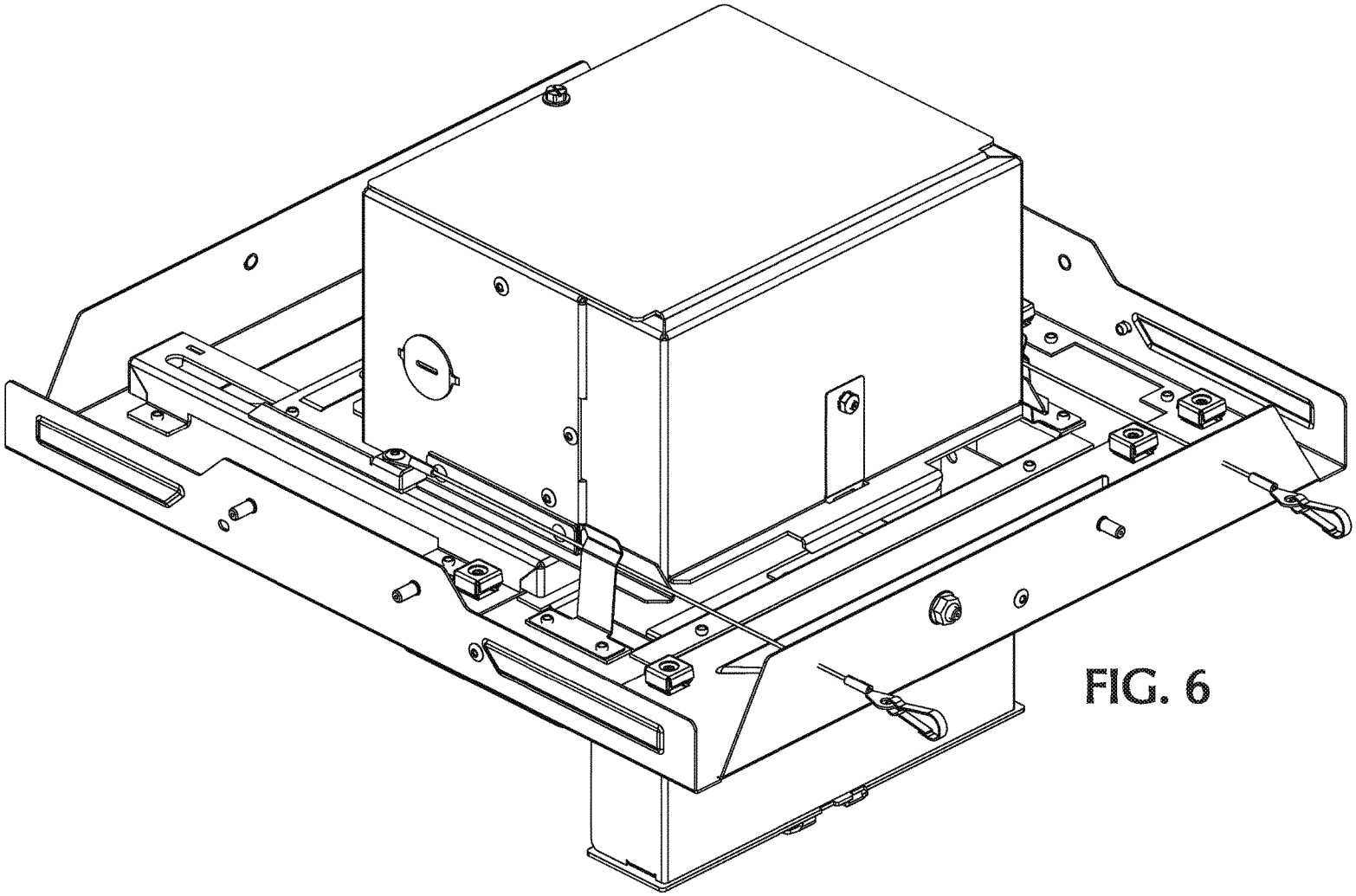
FIG. 6 is a perspective view from the top of the light fixture of FIG. 1, showing the driver drawer being removed from the light fixture.
Figure 7:
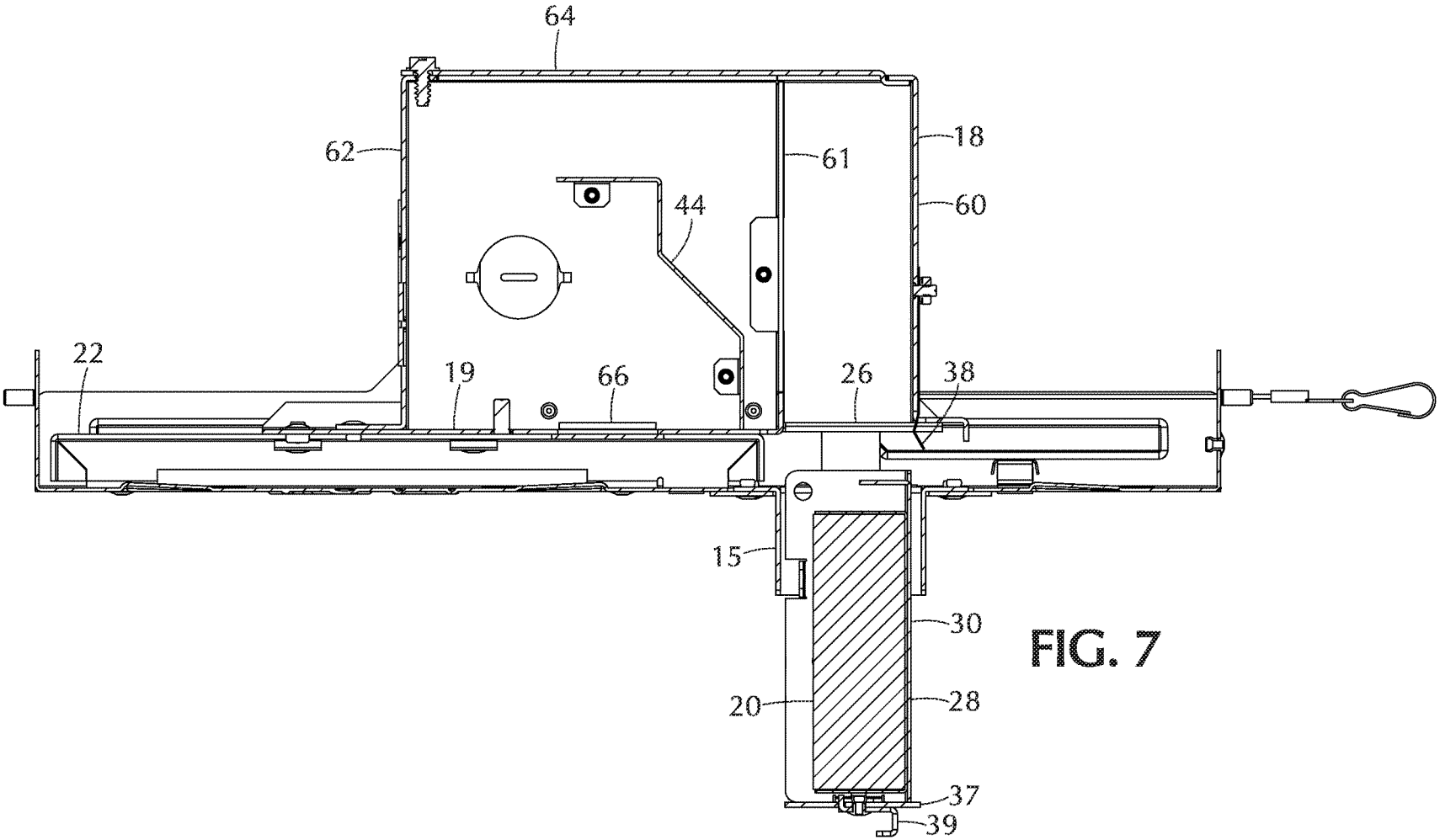
FIG. 7 is a cross-section view of the light fixture of FIG. 1 taken in a vertical plane, showing the driver drawer being removed from the light fixture.
Figure 8:
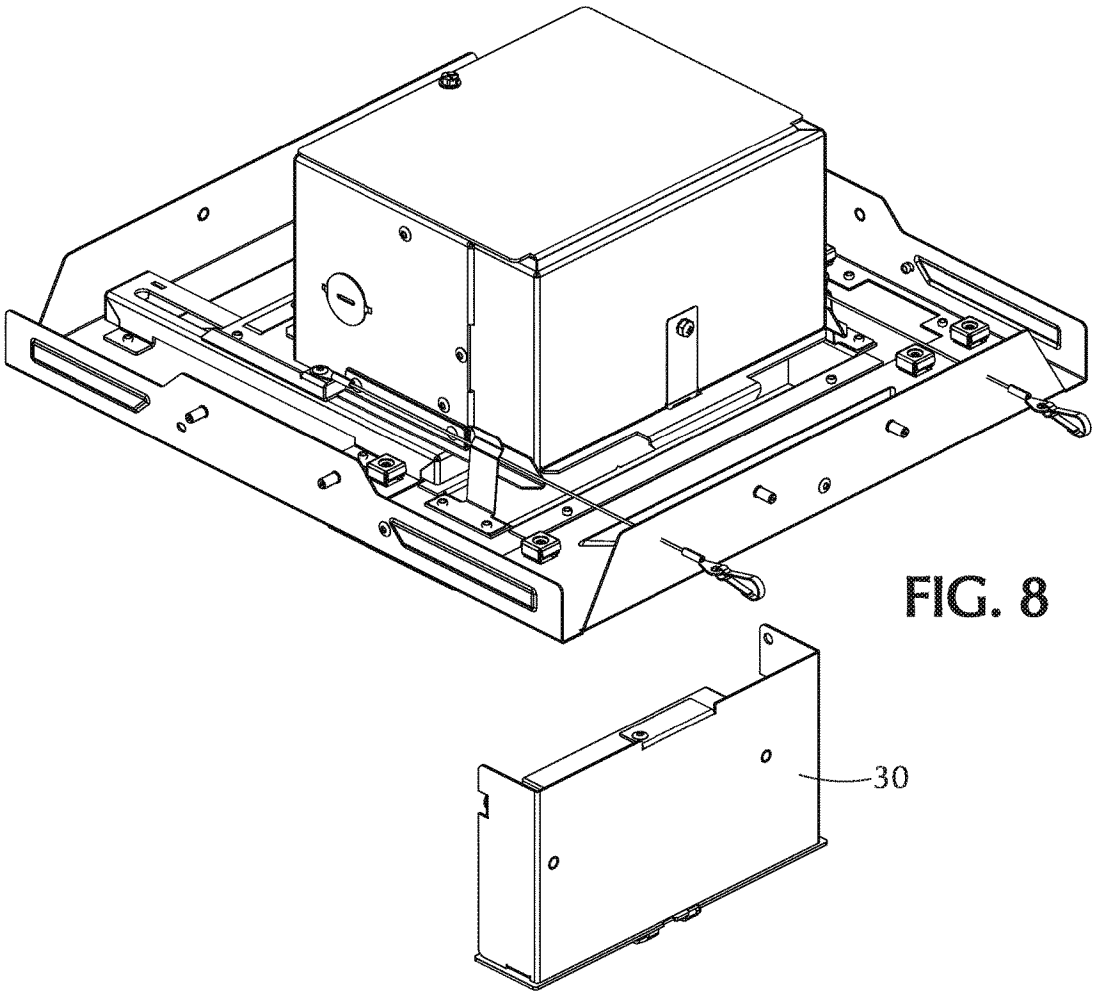
FIG. 8 is a perspective view from the top of the light fixture of FIG. 1, showing the driver drawer removed from the light fixture.
Figure 9:
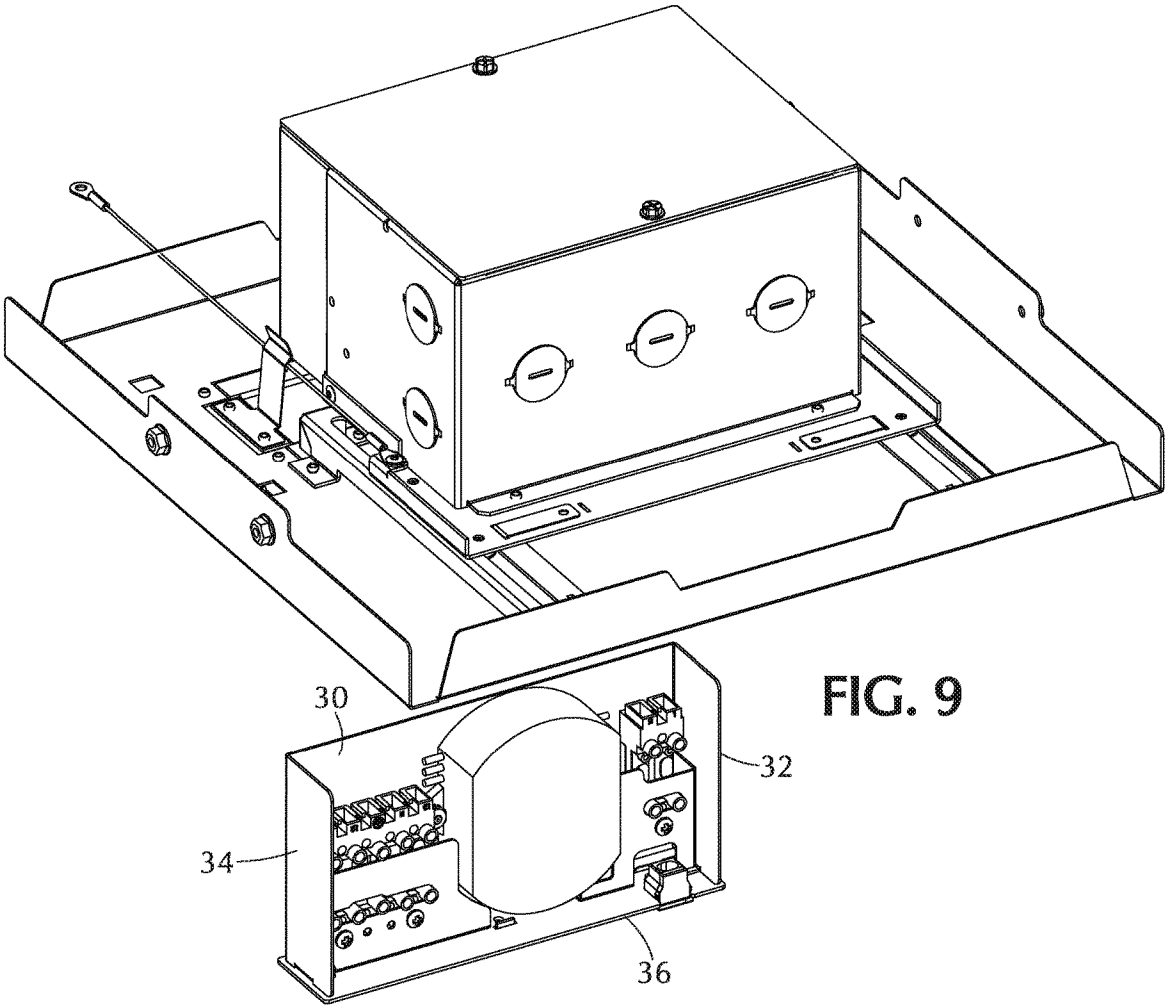
FIG. 9 is a perspective view from the top of the light fixture of FIG. 1, showing the driver drawer being removed from the light fixture.
Figure 10:
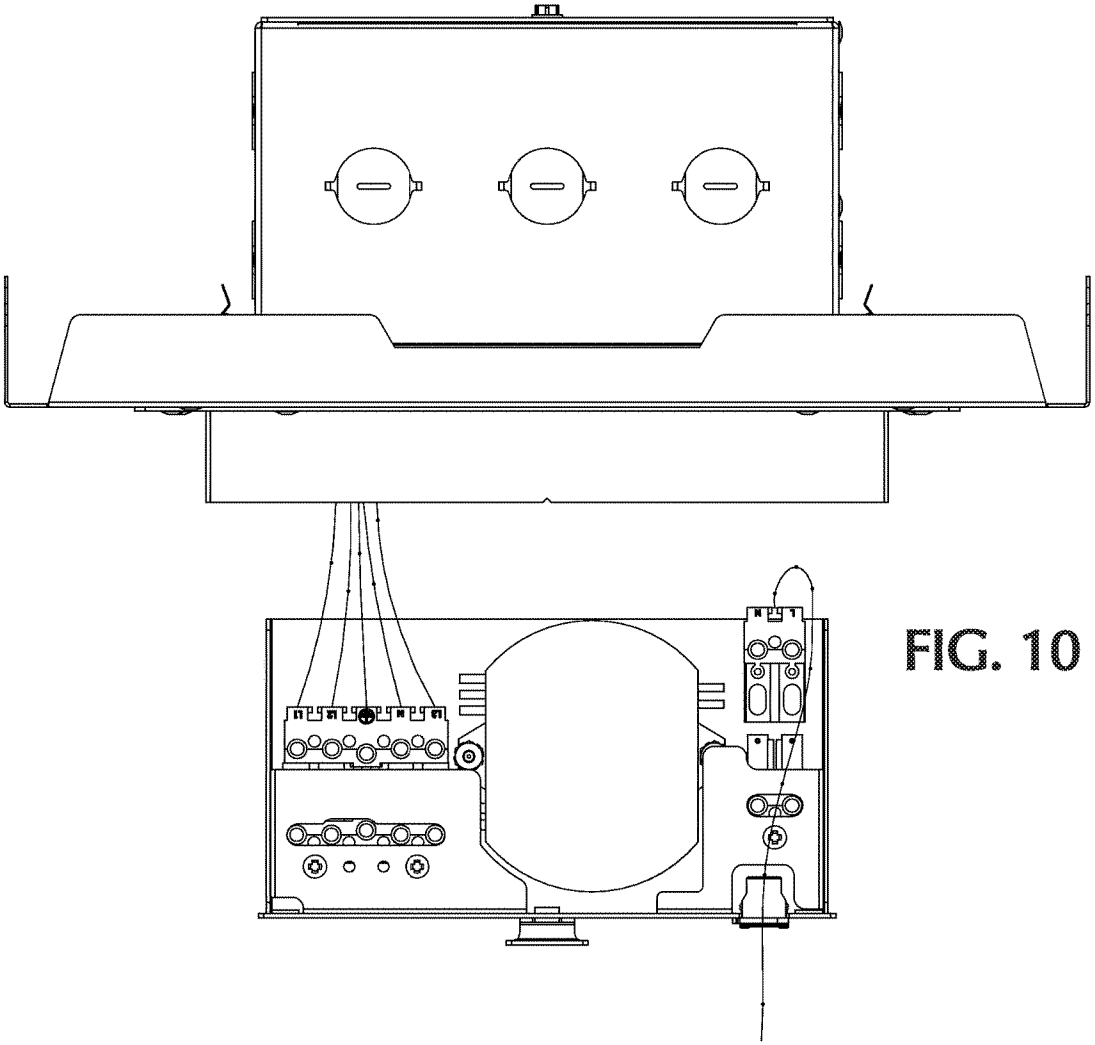
FIG. 10 is a side elevation view of the driver drawer of the light fixture of FIG. 1.
Figure 11:
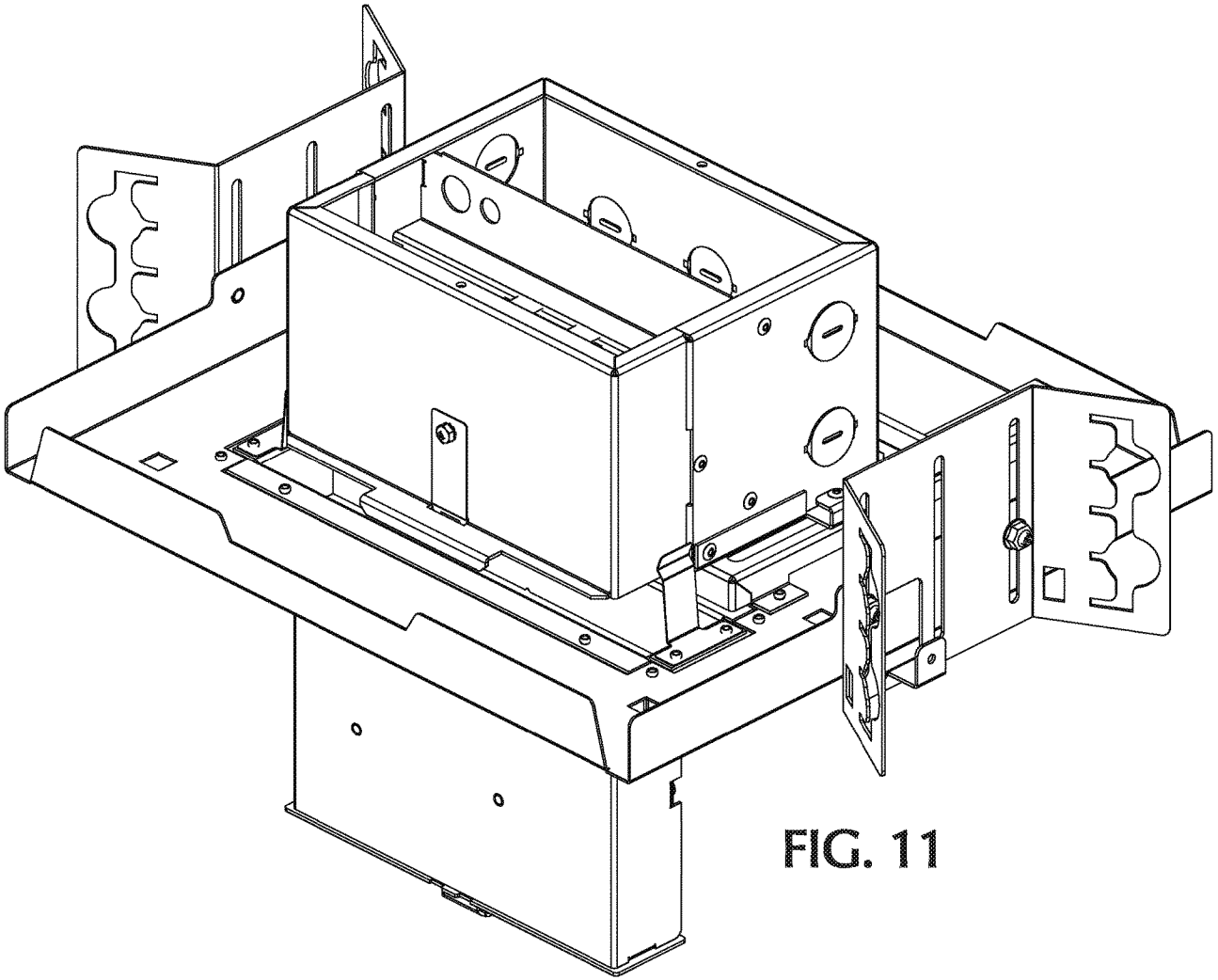
FIG. 11 is a perspective view of the light fixture of FIG. 1 showing the interior of the enclosure.

Referring to FIGS. 1-16, the light fixture 10 is especially adapted for recessed lighting applications and other applications and can be, for example, mounted in a ceiling or wall location. The light fixture 10 includes a frame 12 adapted to mount the light fixture to a support structure, such as joists or other structure, with a room-facing side of the light fixture facing an interior of a room. Attachment devices, such as "butterfly" brackets (see FIG. 11) or other suitable devices can be connected to the frame 12 to secure the light fixture 10 to such support structure.

The frame 12 can have a substantially planar base 13 and up-turned flanges on four sides of the base, extending away from the room-facing side of the light fixture (i.e., away from an interior of the room).

The frame 12 includes an aperture 14 in the base 13 which can be elongated and/or rectangular in shape and can be defined at least in part by a peripheral flange 15 surrounding the periphery of the aperture 14 and extending downwardly from the frame 12 on the room-facing side of the light fixture toward the interior of the room. A vertical axis (Y), which can be an optical axis of the lighting module, passes vertically through the aperture 14 perpendicular to a plane of the aperture.

The light fixture 10 has a lighting module 16 operable to emit light from the light fixture 10 into an interior of the room. For example, the lighting module 16 can include a plurality of DC and/or AC LED lighting units. The lighting module 16 is removably mountable in the aperture 14 of the frame 12 from a room-facing side of the light fixture and can include a trim element 94 on a first (bottom) side which closely abuts or contacts a free end of the peripheral flange 15 surrounding the aperture 14 and a body portion 96. The lighting module 16 can also have a plurality of heat-dissipation fins 98 extending from a second (top) side of the lighting module 16. When the lighting module 16 is mounted in the aperture 14 a portion of the lighting module 16 extends into a space above a top of the base 13 of the frame 12 (i.e., opposite the room-facing side of the light fixture).

Preferably, the lighting module 16 and aperture 14 are sized and shaped such that they have substantially the same (horizontal) cross-section shape and such that the aperture 14 closely surrounds the lighting module 16 when installed. For example, as depicted, both the aperture 14 and the lighting module can have a substantially elongated, rectangular (horizontal) cross section having a horizontal lateral (short) axis (X) and a horizontal longitudinal (long) axis (Z), where the X, Y, and Z axes are mutually perpendicular.

In an embodiment, frame 12 includes a pair of lighting module mounts 17 located on opposing sides of the aperture 14, such that the lateral axis (X) of the aperture is intermediate the lighting module mounts. The lighting module mounts 17 extend upwardly from a top of the base 13 of the frame 12 (i.e., away from the room-facing side of the light fixture) and are adapted to engage opposing sides of the lighting module 16 (along the longitudinal axis thereof) and to retain the lighting module 16 in the aperture once inserted. The lighting module mounts 17 are adapted to engage and retain the lighting module 16 upon application of a predetermined upward (vertical) force on the lighting module (i.e., away from the interior of the room) and to release the lighting module 16 upon application of a predetermined downward (vertical) force on the lighting module 16 (i.e., toward the interior of the room) such that the lighting module 16 can be mounted and dismounted from the frame 12 without the use of tools.

In one embodiment (See FIG. 3), the lighting module mounts 17 are adapted to resiliently deflect away from the lighting module (along the longitudinal axis of the aperture/lighting module) during mounting and dismounting of the lighting module 16, and include a protrusion adapted to releasably engage a recess or groove in the associated end of the lighting module 16. In another embodiment (See FIGS. 15-16), the lighting module mounts 17 include sockets 74, 76 connected to the frame 12 which are adapted to releasably receive and engage a pair of tabs 70, 72 extending upwardly from the opposing ends of the lighting module 16. The sockets 74, 76 can be mounted on rigid supports connected to the frame.

The light fixture 10 includes an enclosure 18 connected to the frame 12. The enclosure 18 is movable relative to the frame along a lateral horizontal movement axis parallel to the lateral axis (X) of the aperture 14, which can be substantially parallel to a general plane of the base 13 of the frame 12. The frame 12 can include a pair of rails 22 adapted to slidably support the enclosure 18 on the frame 12 and to permit the enclosure 18 to translate along the movement axis. The rails 22 can have elongated, parallel slots 24 which are engaged by sliding fasteners connected to the enclosure 18. The rails 22 are raised above (spaced from) the base 13 of the frame 12 such that a bottom of the enclosure is similarly spaced from the frame 12.

The enclosure 18 has a driver compartment 40 for housing a lighting driver 20 and a junction compartment 42 (i.e., junction box) for housing connections between the lighting driver 20 and a power source (e.g., an A/C power source and a lighting driver operable to receive A/C power and drive LEDs). The enclosure can be metal and substantially in the form of a six-sided box as depicted, with pre-formed removable cut outs for wiring. The enclosure can include a pair of end walls 60, 62 spaced apart in the direction of the movement axis.

The junction compartment 42 can be disposed laterally adjacent (i.e. abutting) the driver compartment 40. For example, the enclosure 18 can have a partition wall 44 disposed between the end walls 60, 62 and extending upwardly from a bottom wall 19 of the enclosure toward a top wall 64 thereof, which divides the interior of the enclosure into the driver and junction compartments 40, 42.

Both the driver compartment 40 and junction compartment 42 have bottom openings to allow access to the interior of the compartment from the room-facing side of the light fixture 10. The driver compartment 40 has an opening 26 in the bottom wall 19 of the enclosure 18 and the junction compartment 42 has an opening 66 in the bottom wall 19. The opening 26 of the driver compartment 40 can be closed during operation by a driver drawer 28, as described in detail below. The junction compartment 42 can include a door 46 (See FIGS. 12-14) connected to the bottom wall 19 which is operable to selectively open and close an opening 66 providing access to the junction compartment 42. The opening 26 of the driver compartment and the opening 66 of the junction compartment 42 are laterally spaced apart (parallel to the movement axis) and are on opposite sides of the partition wall 44.

Figure 12:
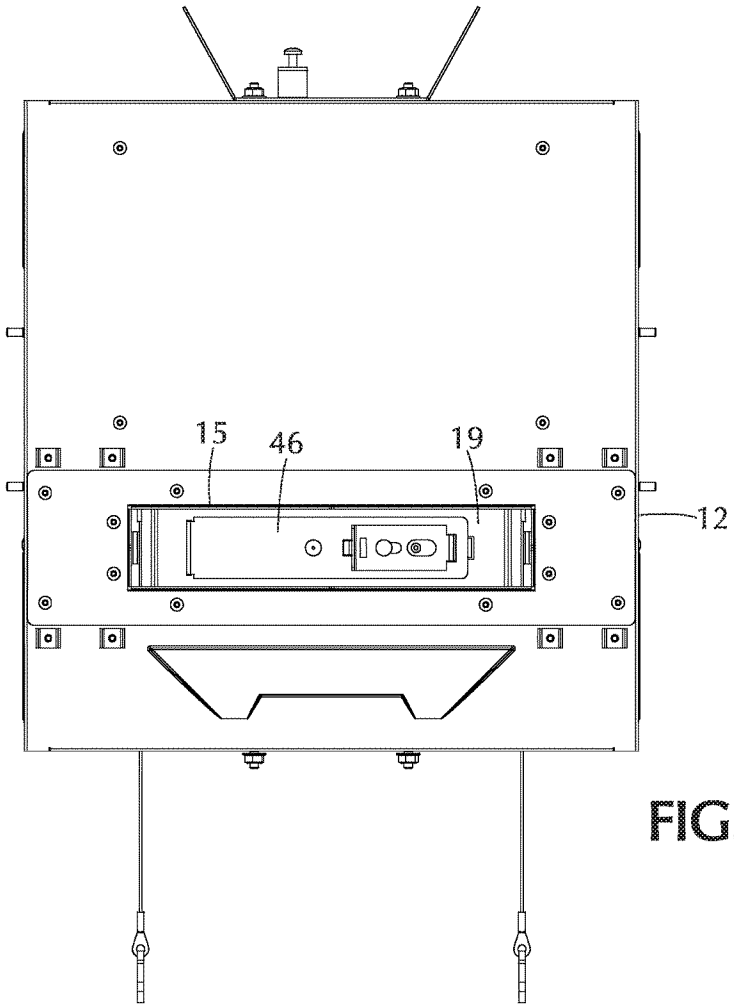
FIG. 12 is a plan view from the bottom of the light fixture of FIG. 1 showing the enclosure in the inspection position with the door aligned with the aperture and in a closed position.
Figure 13:
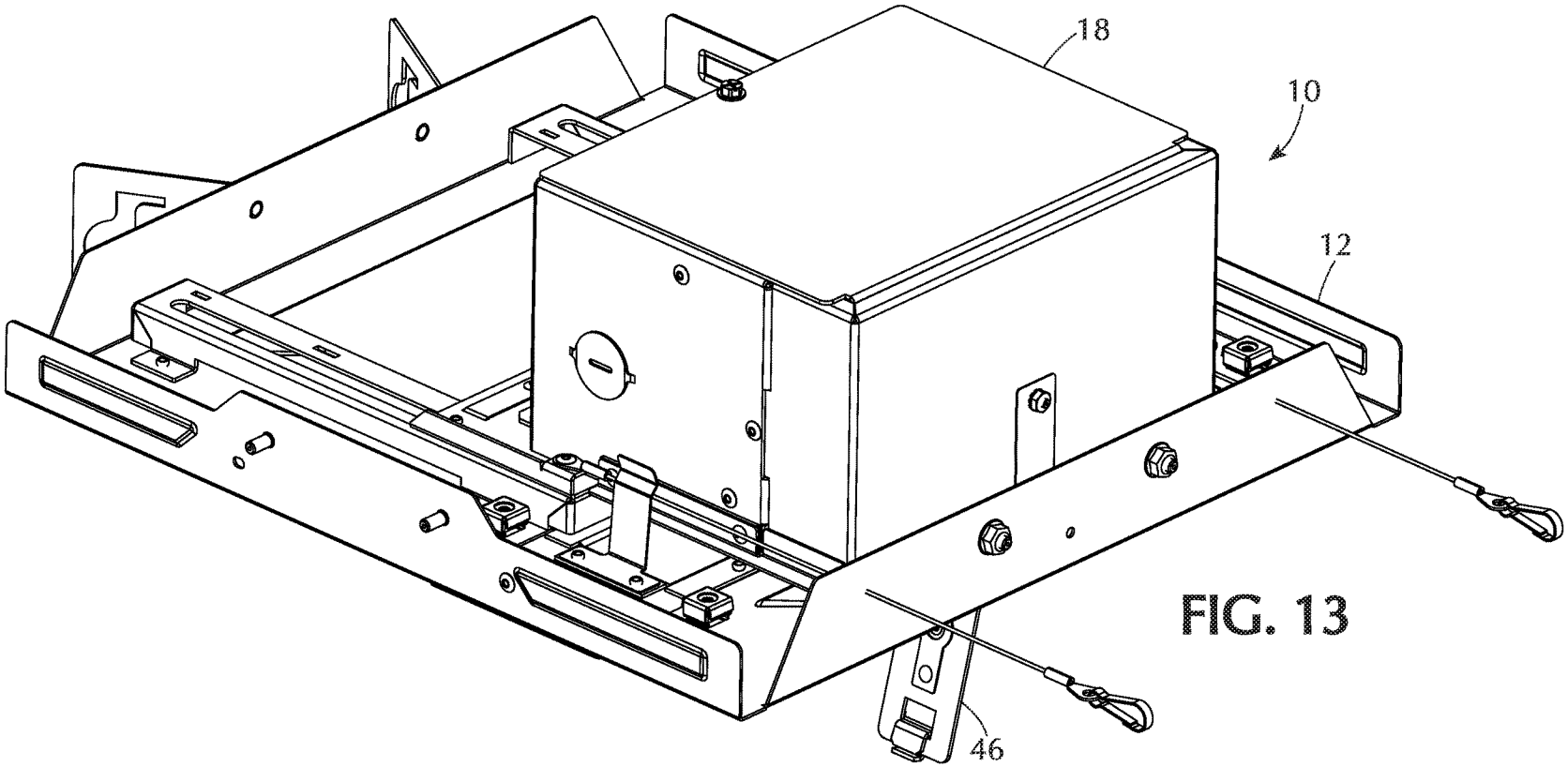
FIG. 13 is a perspective view from the top of the light fixture of FIG. 1, showing the door in an open position.
Figure 14:
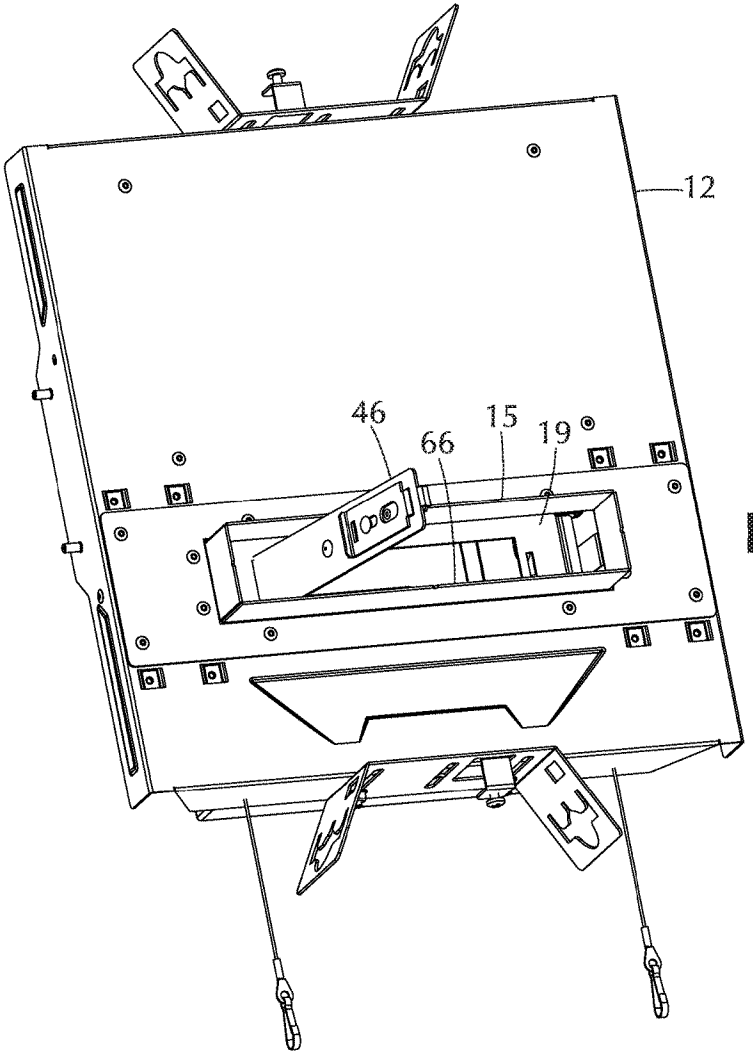
FIG. 14 is a perspective view from the bottom of the light fixture of FIG. 1, showing the door in an open position.
Figure 15:
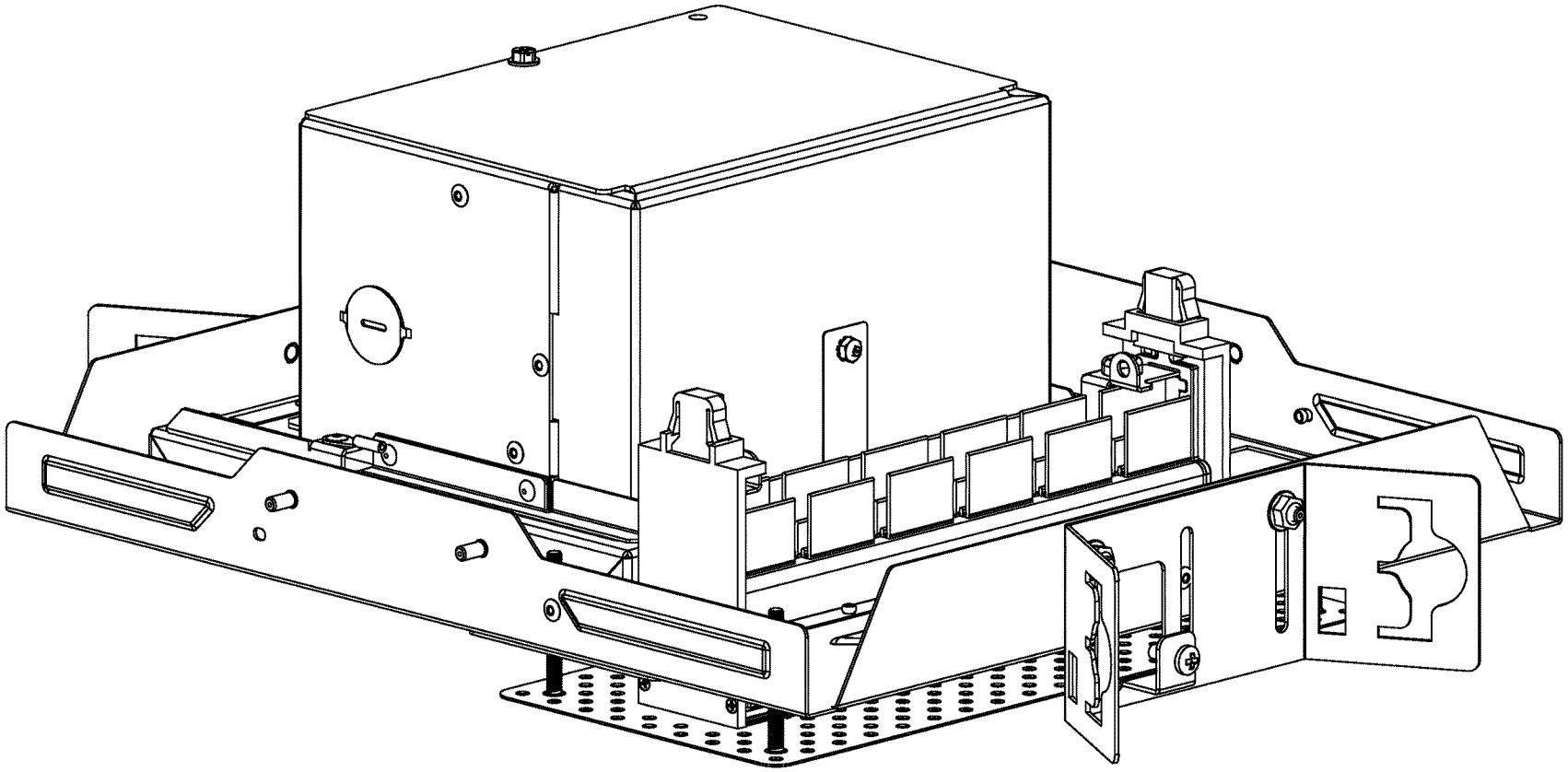
FIG. 15 is a perspective view from the top of a light fixture in accordance with an embodiment of the present invention, showing the lighting module mounted in the aperture.
Figure 16:
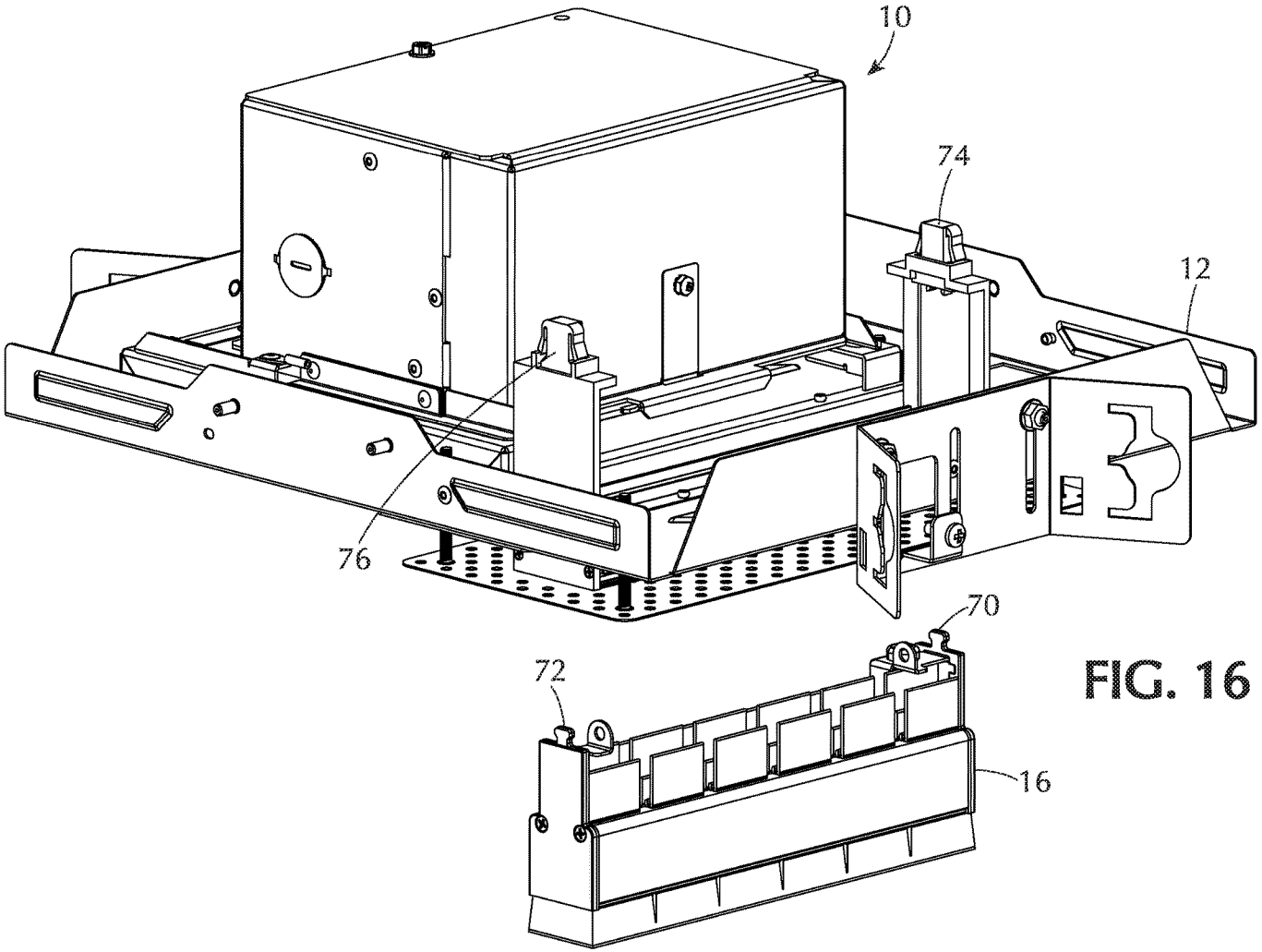
FIG. 16 is a perspective view from the top of the light fixture of FIG. 15, showing the lighting module removed from the aperture.
Figure 17:
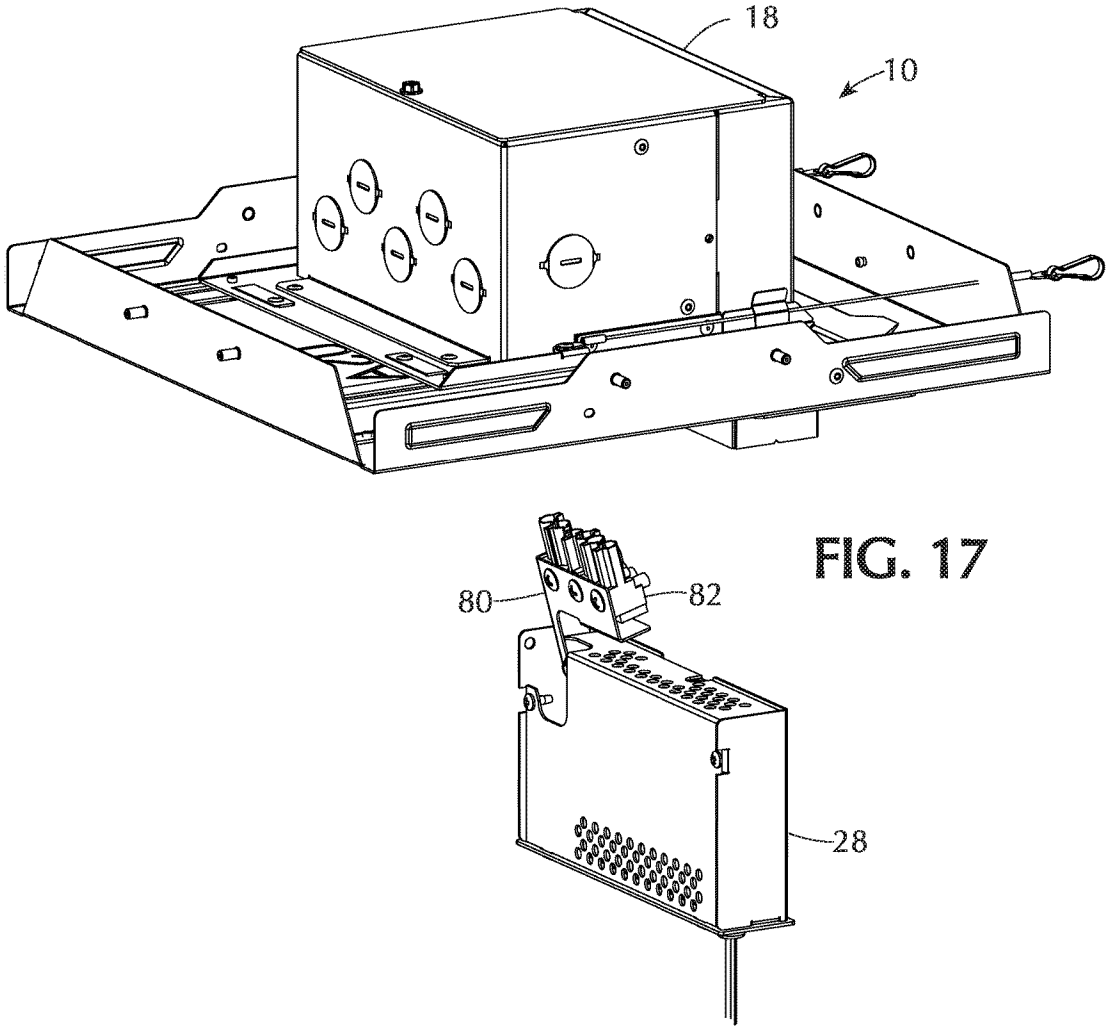
FIG. 17 is a perspective view from the top of a light fixture in accordance with an embodiment of the present invention, showing the enclosure in the service position.
Figure 18:
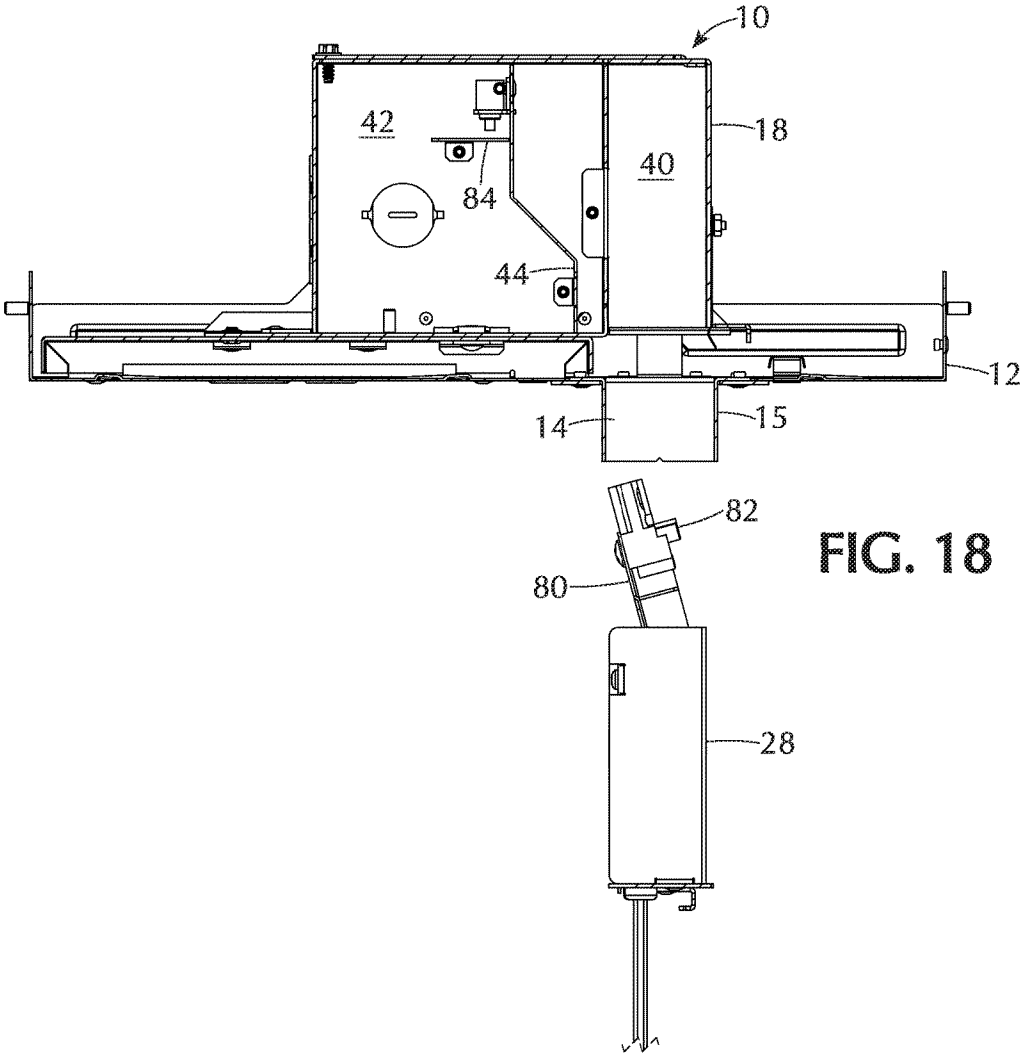
FIG. 18-20 are side elevation views of the light fixture of FIG. 17, showing various stages of mounting the driver drawer in the enclosure.
Figure 19:
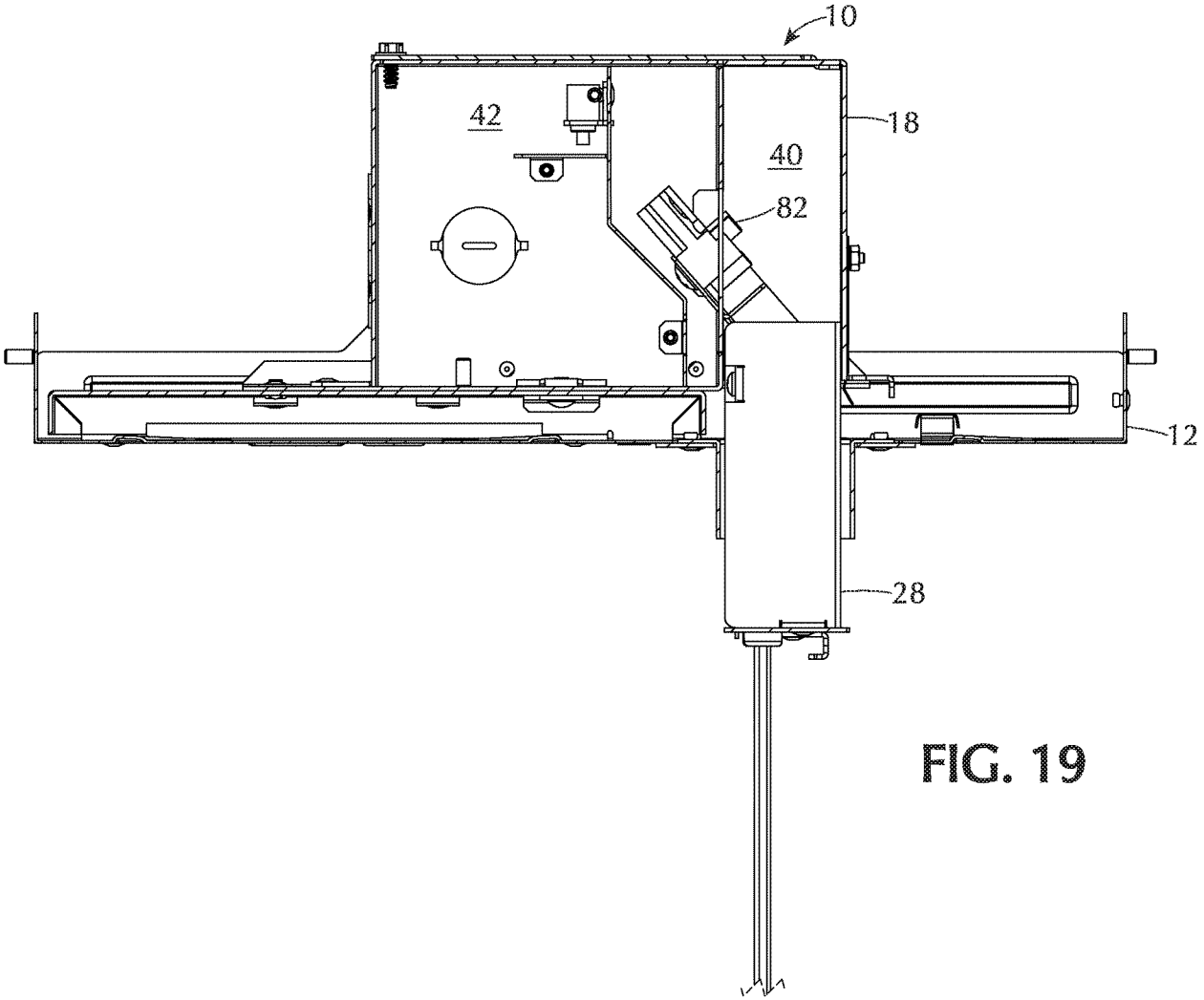
Figure 20:
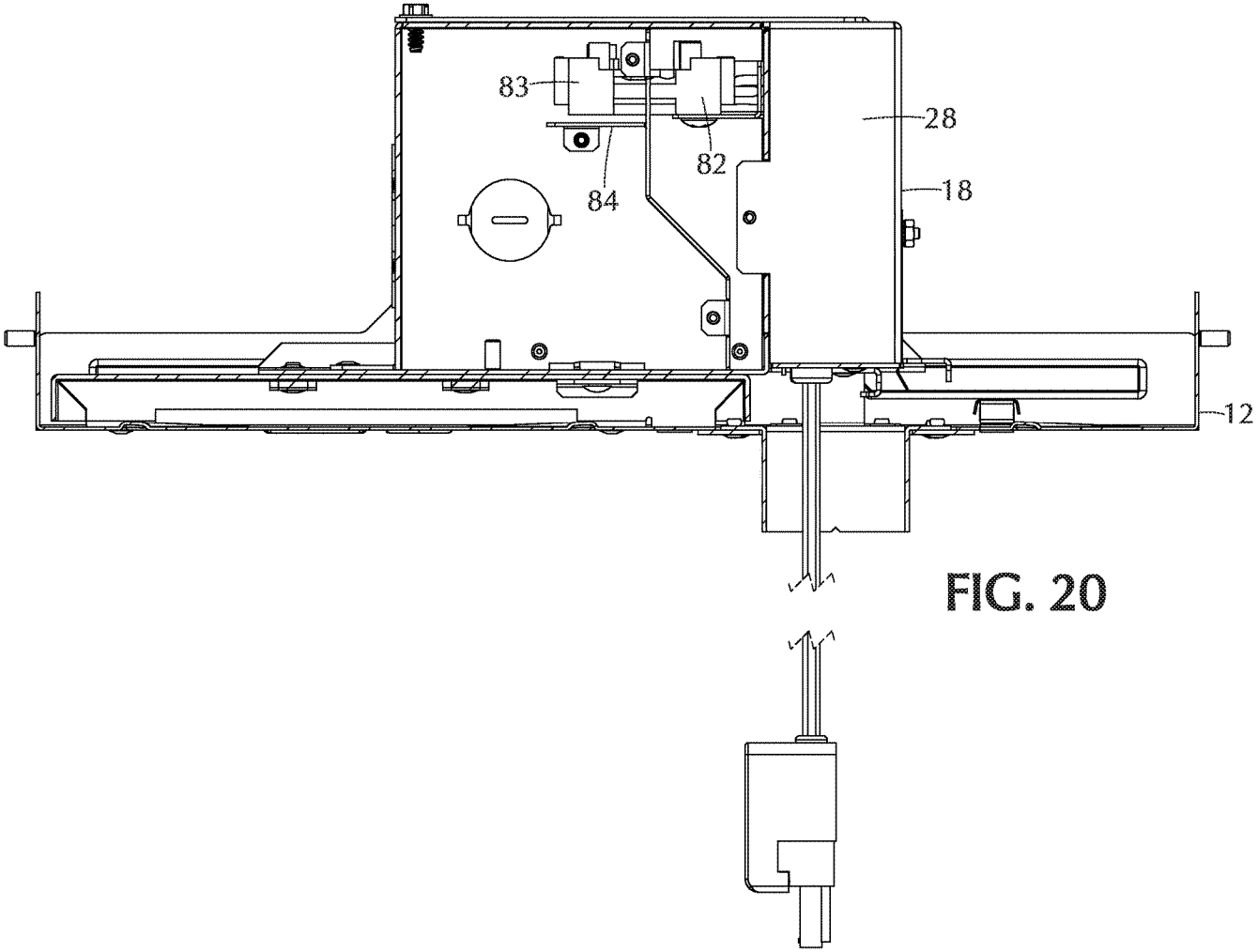
Figure 21:
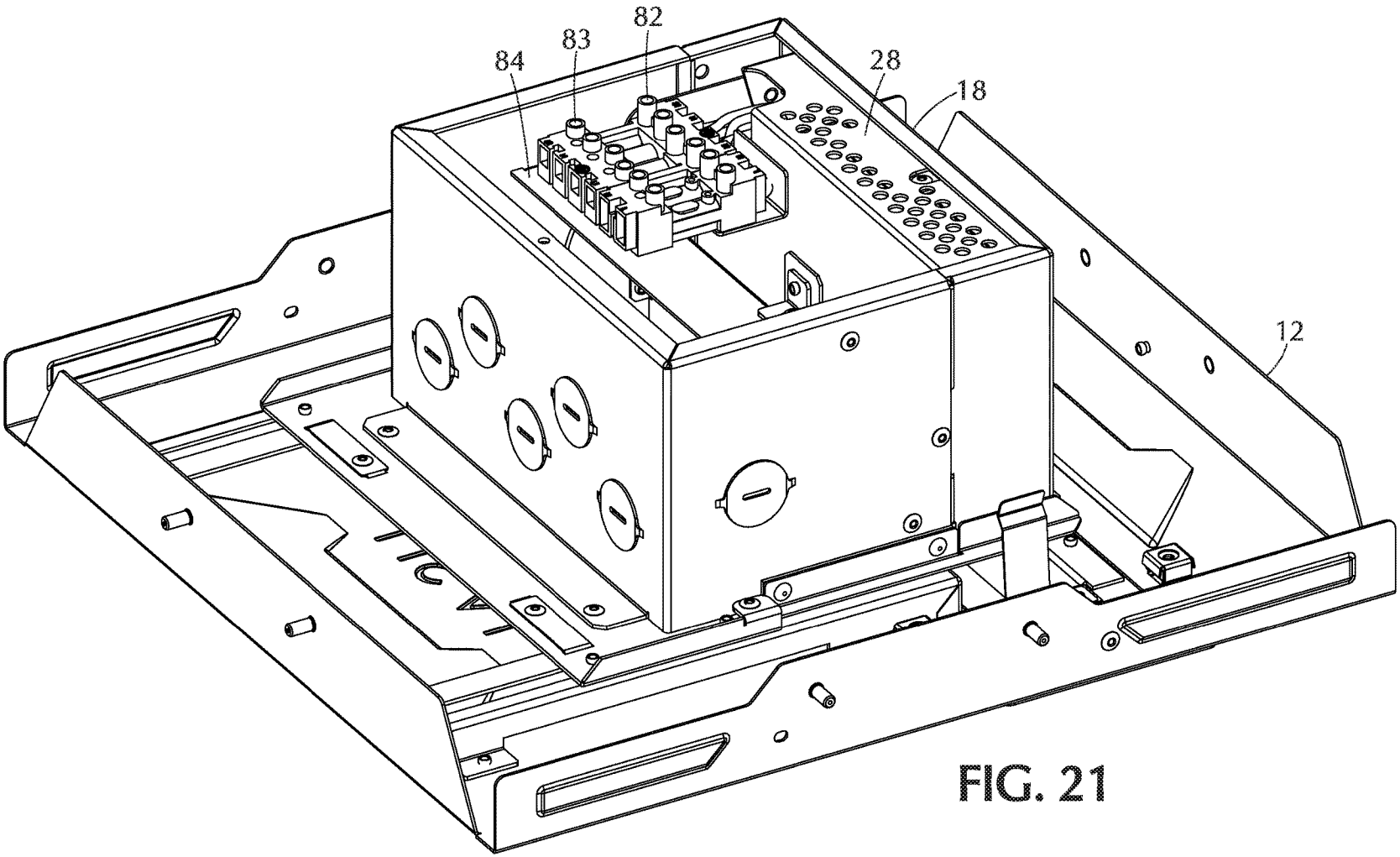
FIG. 21 is a perspective view from the top of the light fixture of FIG. 17, showing the driver drawer installed in the enclosure.

Due to the movement of the enclosure 18, the light fixture 10 has a number of positions, including an operation position (See e.g., FIGS. 1-4), a service position (FIGS. 5-9), and an inspection position (FIGS. 12-14). The operation position can be a limit position of the movement of the enclosure 18 in one direction along the movement axis, the inspection position can be a limit position in an opposite direction along the movement axis, and the service position can be intermediate the operation and inspection positions.

In an embodiment, in the operation position (See e.g., FIGS. 1-4), the enclosure 18 (including the driver and junction compartments 40, 42 thereof) is laterally spaced from the aperture 14 along the movement axis. In this position, the lighting module 16 can be coupled electrically to the lighting driver 20 (previously installed in the enclosure) via wires extending from the lighting driver 20 through the aperture 14, and the lighting module 16 can be mounted in the aperture 14 from a room-facing side of the light fixture 10 such that the light fixture 10 is operable. In the operation position, the end walls 60, 62 of the enclosure 18 are laterally displaced from the aperture 14 and are disposed on the same side of the aperture 14.

The light fixture 10 has a service position (See FIGS. 5-11) wherein the enclosure 18 is substantially spaced from the operation position along the movement axis. In the service position, the opening 26 of the driver compartment 40 is laterally aligned with (i.e., is disposed vertically over/above) the aperture 14 allowing service of the light fixture 10, including installation, removal and replacement of the lighting driver 20 into/from the interior of the driver compartment 40 through the aperture 14 of the frame 12 and the opening 26 of the driver compartment 40, from the room-facing side of the light fixture 10. In this position, the end walls 60, 62 of the enclosure 18 are disposed on opposite sides of the aperture 14.

In an embodiment, the lighting driver 20 is mounted to a driver drawer 28 adapted, sized and shaped to be received through the aperture 14 of the frame 12 and the opening 26 of the driver compartment 40, and adapted to removably mount to the interior of the driver compartment 40, through the aperture 14 of the frame 12 and the opening 26 of the driver compartment. Preferably, the driver drawer 28 mounts in (and dismounts from) the driver compartment 40 in a linear, vertical direction. The driver drawer 28 can have a base 30, opposed side walls 32, 34, and a bottom wall 36. The base 30 of the driver drawer 28 is adapted to removably mount the lighting driver 20 thereto, for example with a screw or other removable fastener. The side walls 32, 34 extend from opposing edges of the base 30 and are interconnected to each other and the base 30 by the bottom wall 36. The bottom wall 36 can be sized and shaped to close the opening 26 of the driver compartment 40 when the driver drawer 28 is mounted in the enclosure 18 to substantially enclose the lighting driver 20 in the enclosure 18. A hook or grasp 39 can be connected to the bottom wall 36 of the driver drawer 28 to facilitate pulling of the driver drawer 28 from the enclosure 18. The grasp 29 is accessible through the aperture 14 from the room-facing side of the light fixture 10 when the enclosure 18 is in the service position.

The enclosure 18 can include a resilient latch 38 operable to removably retain the driver drawer 28 (and lighting driver 20 attached thereto) in the enclosure 18. When the driver drawer 28 is installed, the latch 38 is biased to engage a protruding edge portion 37 of the bottom wall 36 of the driver drawer 28 and is operable to retain the driver drawer 28 in the enclosure against, for example, the force of gravity. The latch 38 is accessible through the aperture 14 from the room-facing side of the light fixture 10, when the enclosure 18 is in the service position. To remove the driver drawer 28, the latch 38 can be manually deflected to disengage the latch 38 from the driver drawer 28. Alternatively or additionally, the latch 38 can be adapted to deflect and disengage from the driver drawer 28 upon application of a substantial pulling (removal) force applied to the driver drawer for example via the grasp 39. Thus, in the service position, the driver drawer 28 can be manually mounted in and removed from the enclosure 18 from the room-facing side of the light fixture 10, without the use of tools.

The driver partition 40 of the enclosure 18 is sized and shaped to closely receive the driver drawer 28 such that, when the driver drawer 28 is inserted into the driver partition 40 with the latch 38 engaged with the driver drawer 28, the driver drawer 28 (and lighting driver 20 mounted thereto) are substantially immobile relative to the enclosure 18. The driver compartment 40 can include a pair of opposed, inwardly-projecting, vertically-aligned flanges 61 which contact or closely abut the side walls 32, 34 of the driver drawer 28 to guide and confine the driver drawer between the flanges and the end wall 60 of the enclosure 18.

The light fixture 10 has an inspection position (See FIGS. 12-14) wherein the enclosure 18 is substantially spaced from the operation and service positions along the movement axis. In the inspection position, the opening 66 of the junction compartment 42 is laterally aligned with (i.e., is disposed vertically over/above) the aperture 14 allowing visual inspection of (and/or physical access to) the interior of the junction compartment 42 through the aperture 14 of the frame 12 and the opening 66 of the junction compartment 42, from the room-facing side of the light fixture 10. In this position, the end walls 60, 62 of the enclosure 18 are disposed on opposite sides of the aperture 14.

The door 46 over the opening 66 of the junction compartment 42 can be hinged to the bottom wall 19 of the enclosure 18 and can open toward the room-facing side of the light fixture 10 such that when the enclosure 18 is in the inspection position and the door 46 is open, the door 46 extends through the aperture 14. Alternatively, the door 46 can be removably attached to the bottom wall 19 of the enclosure 18 and can be removed (and replaced) through the aperture 14, from a room-facing side of the light fixture 10, when the enclosure 18 is in the service position, without the use of tools.

In an embodiment, to move the enclosure 18 in to the service or inspection positions, the lighting module 16 must be removed because, in such positions, a portion of the enclosure 18 occupies space above the aperture 14 otherwise occupied by a portion of the (installed) lighting module 16. Once in such positions, a portion of the enclosure 18 is supported over the aperture 14 by the rails 22 in cantilever fashion and a portion of the enclosure is disposed between the mounting clips 17 of the frame 12. Particularly, in the service position, the driver compartment 40 is disposed between the lighting module mounts 17 and in the inspection position, the junction compartment 42 is disposed between lighting module mounts 17. When the enclosure 18 is returned or moved into the operation position, the enclosure 18 no longer occupies any space above the aperture 14 such that the lighting module 16 can be mounted in the aperture 14.

In an embodiment, the light fixture 10 can include at least one safety tether 50, such as a flexible wire or cord or similar flexible element, connected between the lighting element 16 and enclosure 18 to prevent unintended disengagement or free-fall of the lighting module 16 from the light fixture and to facilitate movement of the enclosure 18 into the service position. A first end of the tether 50 can be securely connected to the movable enclosure 18 and a second end of the tether can be removably connected to the lighting element 16. Thus, the tether secures the lighting module 16 to the light fixture 10 during the mounting and removal process to prevent unintended disengagement of the lighting module. In addition, the tether can be used to move the enclosure 18 by pulling on the tether (and/or lighting element 16 connected thereto) from the room-facing side of the light fixture 10 (through the aperture 14) which causes the enclosure to slide along the rails 22 toward the service position. Once the enclosure 18 has moved a sufficient distance toward the service position, the enclosure 18 can then be manually moved further into the service position by reaching into the aperture 14 from the room-facing side of the light fixture 10 and pushing on the enclosure 18. As depicted, the light fixture 10 can include two tethers 50 connected to opposite sides of the enclosure 18 and lighting module 16, on opposite sides of the movement axis such that the pulling force on the enclosure 18 is distributed on either side of the enclosure 18.

Referring to FIGS. 17-21, the driver drawer 28 can include a pivoting connector bracket 80 operable to mount a modular electrical connector 82 thereto. The modular connector 82 mounted to bracket 80 is electrically connected to the lighting driver 20 mounted to the driver drawer 28 via wires and is adapted to releasably connect to a second, complementary modular connector 83 that has an electrical connection (not shown) to the power source within the junction compartment 42. Preferably, the second module connector 83 can be pulled out of the light fixture through the aperture 14 to allow connection to the module connector 82 affixed to the driver drawer 28.

As described above, the driver drawer 28 preferably mounts into (and dismounts from) the driver compartment 40 in a linear, vertical manner. During mounting of the driver drawer 28, the bracket 80 is operable to pivot relative to the body of the driver drawer 28 (and relative to the enclosure 18) toward the junction compartment 42 about a horizontal axis perpendicular to the movement axis. The bracket 80 pivots from an upward orientation (which as shown can be vertical or substantially vertical) during initial insertion and removal of the driver drawer 28, to a downward orientation (horizontal or substantially horizontal) when the driver drawer 28 is fully mounted within the enclosure 18.

In the upward orientation, the bracket 80 and modular connector 82 affixed thereto extend above a body of the driver drawer 28 and thus are the leading portion during mounting of the driver drawer, and trailing portion during dismounting. The partition wall 44 preferably includes an opening sized and shaped to receive the bracket 80 and modular connector 82 therethrough and can include a horizontal shelf 84 for supporting the bracket 80.

Figure 22:
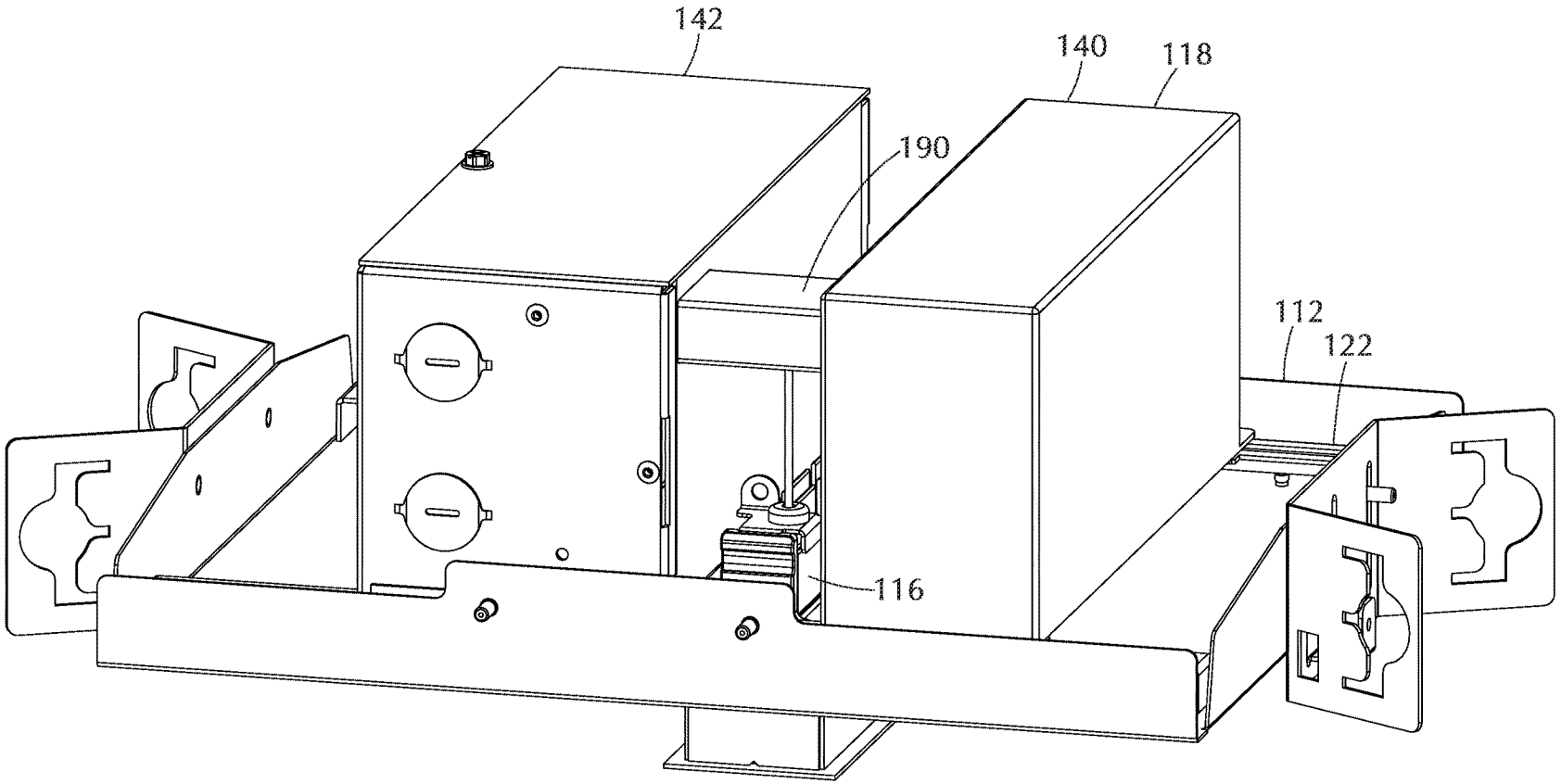
FIG. 22 is a perspective view from the top of a light fixture in accordance with an embodiment of the present invention, showing the enclosure in the operation position.
Figure 23:
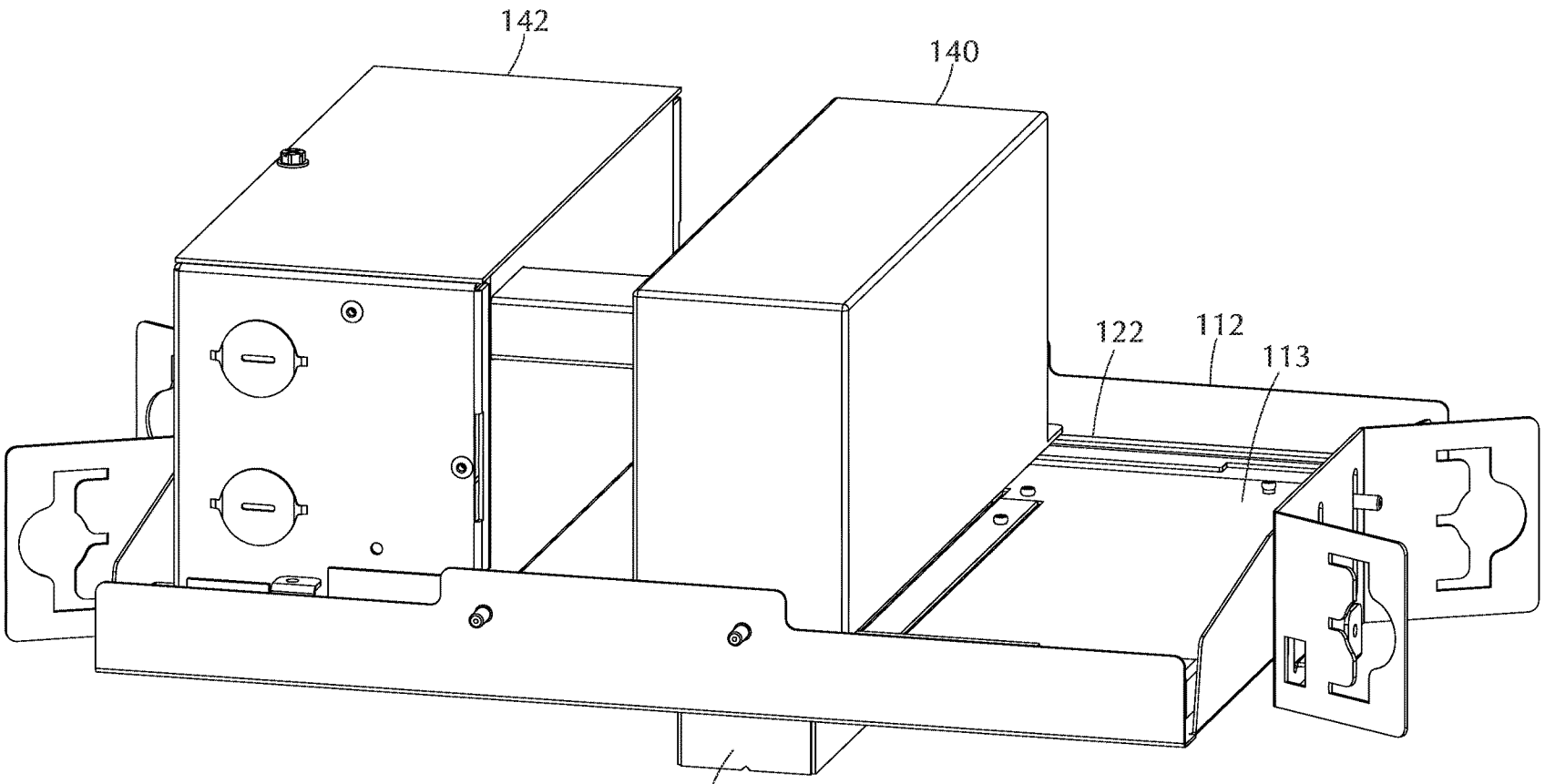
FIG. 23 is a perspective view from the top of the light fixture of FIG. 22, showing the enclosure in the service position.
Figure 24:
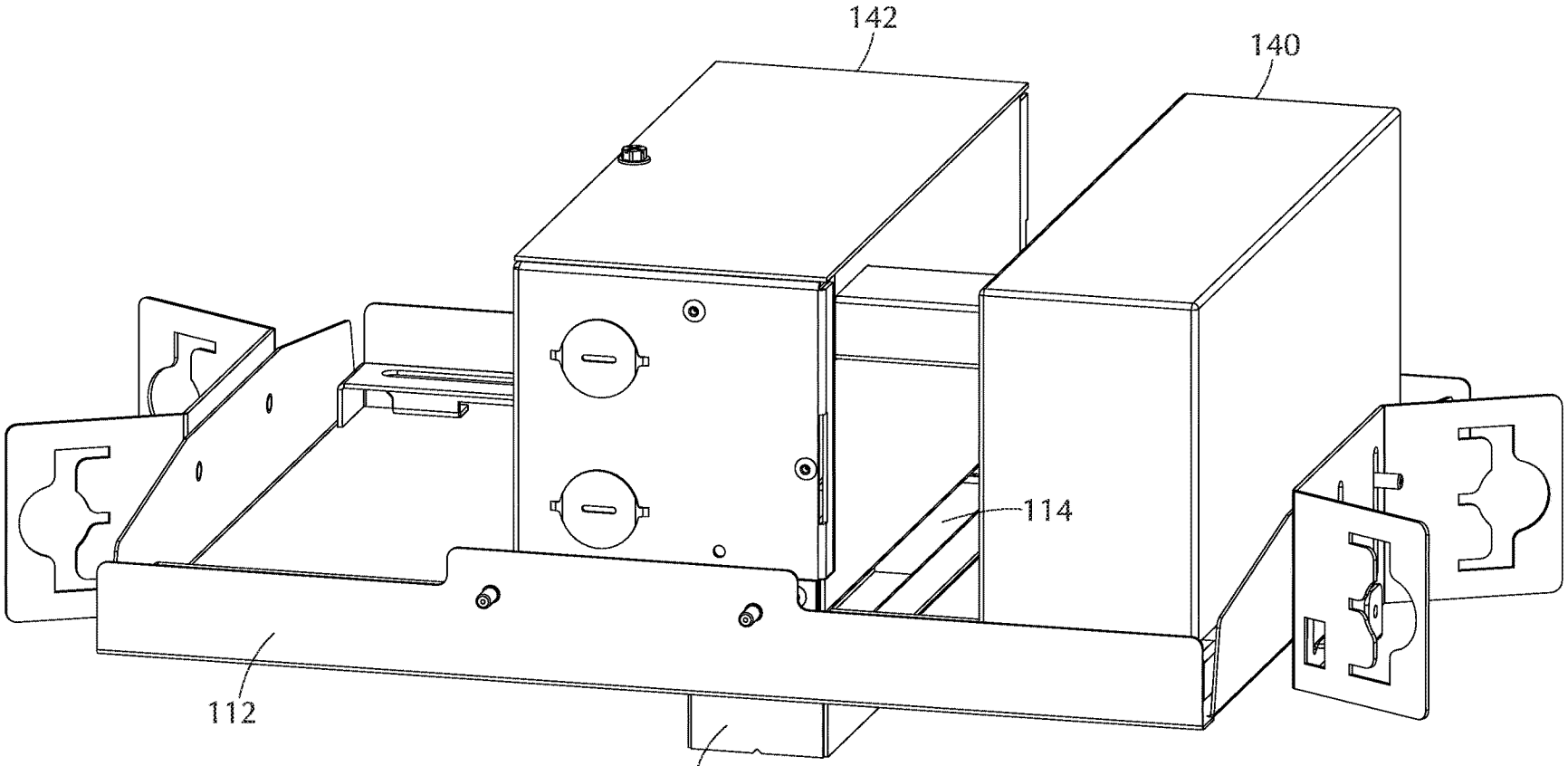
FIG. 24 is a perspective view from the top of the light fixture of FIG. 22, showing the enclosure in the inspection position.

Referring to FIGS. 22-24, an alternative embodiment of the light fixture 110 is constructed similarly to the embodiments described above however the driver compartment 140 and junction compartment 142 of the enclosure 118 are separated laterally, parallel to the movement axis. The driver and junction compartments 140, 142 can interconnected by a rigid or flexible conduit 190 containing wires for conveying power from the power source to the lighting driver (not shown). The driver and junction compartments 140, 142 are each slidably mounted to a pair of rails 122 which allow the driver and junction compartments 140, 142 to translate relative to the frame 112 along the movement axis. The rails 122 preferably extend substantially an entire width of the base 113 of the frame 112.

In the operation position (FIG. 22), the driver compartment 140 and junction compartment 140 are each laterally displaced from the aperture of the frame 112, but in opposite directions such that they are on opposite sides of the aperture. The driver compartment 140 and junction compartment 142 are spaced apart laterally a distance greater than a lateral width of the aperture and/or lighting module 116, such that, in the operation position, the lighting module 116 can be mounted in the aperture. In this position, the lighting module 116 can be coupled electrically to the lighting driver (previously installed in the enclosure 118) via wires extending from the lighting driver through the aperture, and the lighting module 116 can be mounted in the aperture from a room-facing side of the light fixture 110 such that the light fixture 110 is operable.

In the service position (FIG. 23), the enclosure 118 is substantially spaced from the operation position along the movement axis in a first direction (e.g., to the left, as depicted) such that the previously described opening of the driver compartment 140 is laterally aligned with (i.e., is disposed vertically over/above) the aperture allowing service of the light fixture 110, including installation, removal and replacement of the lighting driver into/from the interior of the driver compartment 140 through the aperture of the frame 112 and the opening of the driver compartment 140, from the room-facing side of the light fixture 110. The junction compartment 142 is laterally displaced from the aperture in the first direction.

In the inspection position (FIG. 24), the enclosure 118 is substantially spaced from the operation position along the movement axis in a second direction (e.g., to the right, as depicted) such that the previously described opening of the junction compartment 142 is laterally aligned with (i.e., is disposed vertically over/above) the aperture allowing at least visual inspection of the interior of the junction compartment 142 through the aperture of the frame 112 and the opening of the junction compartment 142, from the room-facing side of the light fixture 110. The driver compartment 140 is laterally displaced from the aperture in the second direction.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A light fixture, comprising:

a frame adapted to mount the light fixture to a support structure with a room-facing side of the light fixture facing an interior of a room, the frame having an aperture;

a lighting module operable to emit light from the light fixture into the room, the lighting module being removably mountable in the aperture from the room-facing side of the light fixture;

a lighting driver operable to electrically drive the lighting module;

an enclosure connected to the frame;

the enclosure having a driver compartment for housing the lighting driver, the driver compartment being movable laterally relative to the frame along a movement axis and having a bottom with an opening sized and shaped to receive the lighting driver;

the enclosure having a junction compartment for housing an electrical connection between the lighting driver and a power source, the junction compartment having a bottom with an opening, and the junction compartment being disposed laterally from the driver compartment along the movement axis and being movable laterally relative to the frame along the movement axis;

the light fixture having an operation position, a service position and an inspection position;

in the operation position, the driver compartment and junction compartment being laterally displaced from the aperture and the lighting module being mountable in the aperture from the room-facing side of the light fixture;

in the service position, the opening of the driver compartment being laterally aligned with the aperture and the junction compartment being laterally displaced from the aperture, and the lighting driver being removably mountable in the driver compartment through the aperture and the opening of the driver compartment, from the room-facing side of the light fixture; and in the inspection position, the opening of the junction compartment being laterally aligned with the aperture, an interior of the junction compartment being visible through the aperture and the opening of the junction compartment, from the room-facing side of the light fixture, and the driver compartment being laterally displaced from the aperture.

2. The light fixture as in claim 1, comprising:

in the operation position, the driver compartment and the junction compartment being laterally displaced from the aperture in a first direction;

in the service position, the junction compartment being laterally displaced from the aperture in the first direction; and in the inspection position, the driver compartment being laterally displaced from the aperture in a second direction opposite the first direction.

3. The light fixture as in claim 2, comprising:

the driver compartment abutting the junction compartment.

4. The light fixture as in claim 1, comprising:

in the operation position, the driver compartment being laterally displaced from the aperture in a first direction and the junction compartment being laterally displaced from the aperture in a second direction opposite the first direction;

in the service position, the junction compartment being laterally displaced from the aperture in the second direction; and in the inspection position, the driver compartment being laterally displaced from the aperture in the first direction.

5. The light fixture as in claim 4, comprising:

the aperture having a lateral width; and the driver compartment being laterally spaced from the junction compartment a distance greater than the lateral width of the aperture.

6. The light fixture as in claim 5, comprising:

the driver compartment and junction compartment being rigidly interconnected.

7. The light fixture as in claim 1, comprising:

the junction compartment having a door operable to selectively cover the opening of the junction compartment;

in the inspection position, the door being operable to open through the aperture, and the door being accessible from the room-facing side of the light fixture.

8. The light fixture as in claim 7, comprising:

the door being removably connectable to the bottom of the junction compartment, and;

in the inspection position, the door being removable from and connectable to the junction compartment through the aperture, from the room-facing side of the light fixture.

9. The light fixture as in claim 1, comprising:

the aperture having opposing ends and having a lateral axis parallel to the movement axis, where the lateral axis is intermediate the opposing ends;

a pair of lighting module mounts fixed to the frame adjacent the opposing ends of the aperture;

in the operation position, the lighting module being mountable in the aperture by the lighting module mounts;

in the service position, the driver compartment being disposed between the lighting module mounts; and in the inspection position, the junction compartment being disposed between lighting module mounts.

10. The light fixture as in claim 1, comprising:

at least one tether connected to the enclosure and removably connected to the lighting module; and tension applied to the tether being operable to urge the light fixture from the operation position toward the service position.

11. The light fixture as in claim 10, comprising:

the enclosure having first and second sides and having a lateral axis parallel to the movement axis, where the lateral axis is intermediate the first and second side; and the tether includes a first tether connected to the first side of the enclosure and a first side of the lighting module and a second tether connected to the second side of the enclosure and a second side of the lighting module.

12. The light fixture as in claim 1, comprising:

the aperture being sized and shaped to closely surround the light module.

13. The light fixture as in claim 1, comprising:

the lighting driver being mounted to a drawer;

the driver drawer being mountable in the driver compartment in the service position;

a bracket pivotally connected to the driver drawer and a modular electrical connector fixed to the bracket and electrically connected to the lighting driver; and the bracket being operable to pivot relative to the driver drawer during mounting and dismounting of the driver drawer in the driver compartment.

* * * * *